US007360876B2

(12) United States Patent
Inoue et al.

(10) Patent No.: US 7,360,876 B2
(45) Date of Patent: Apr. 22, 2008

(54) LIQUID SUPPLY SYSTEM, FLUID COMMUNICATING STRUCTURE, INK SUPPLY SYSTEM, AND INKJET RECORDING HEAD UTILIZING THE FLUID COMMUNICATING STRUCTURE

(75) Inventors: Ryoji Inoue, Kanagawa-ken (JP); Hiroyuki Ishinaga, Tokyo (JP); Nobuyuki Kuwabara, Tokyo (JP); Tetsuya Ohashi, Chiba-ken (JP); Hideki Ogura, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 10/529,101

(22) PCT Filed: Sep. 29, 2003

(86) PCT No.: PCT/JP03/12421

§ 371 (c)(1),
(2), (4) Date: Mar. 24, 2005

(87) PCT Pub. No.: WO2004/028817

PCT Pub. Date: Apr. 8, 2004

(65) Prior Publication Data

US 2006/0017787 A1 Jan. 26, 2006

(30) Foreign Application Priority Data

Sep. 30, 2002 (JP) ..... 2002-287833

(51) Int. Cl.
*B41J 2/175* (2006.01)

(52) U.S. Cl. ..... 347/85; 347/86

(58) Field of Classification Search ..... 347/85, 347/86, 87; 141/2, 18
See application file for complete search history.

(56) References Cited

U.S. PATENT DOCUMENTS

| | | | | |
|---|---|---|---|---|
| 4,677,448 | A | 6/1987 | Mizusawa et al. | 346/140 R |
| 5,128,690 | A | 7/1992 | Nozawa | 346/1.1 |
| 5,896,152 | A | 4/1999 | Ohashi | 347/86 |
| 5,905,518 | A * | 5/1999 | DeFilippis | 347/85 |
| 5,963,237 | A | 10/1999 | Ikkatai et al. | 347/85 |
| 6,234,615 | B1 * | 5/2001 | Tsukuda | 347/85 |
| 6,325,498 | B1 | 12/2001 | Higuma et al. | 347/86 |
| 6,347,863 | B1 | 2/2002 | Yuen | 347/85 |

(Continued)

FOREIGN PATENT DOCUMENTS

| | | |
|---|---|---|
| CN | 1370681 | 9/2002 |

(Continued)

*Primary Examiner*—Anh T. N. Vo
(74) *Attorney, Agent, or Firm*—Fitzpatrick, Cella, Harper & Scinto

(57) ABSTRACT

A liquid (ink) supply system having a closed structure with respect to an inkjet recording head is configured such that a gas hindering a recording operation and a liquid supply operation can be rapidly and smoothly eliminated from a liquid supply system without involving any complication in structure. An ink tank (10) and a liquid chamber (50) for leading ink supplied to the recording head (20) are brought into fluid communication via two communication channels (53 and 54). Thus, in the state where the gas exists inside the liquid chamber, the ink is moved from the ink tank (10) via one communication channel (53), while the gas is transferred to the ink tank (10) via the other communication channel (54).

11 Claims, 23 Drawing Sheets

U.S. PATENT DOCUMENTS

| | | | | |
|---|---|---|---|---|
| 6,450,631 | B1 | 9/2002 | Hayashi et al. | 347/86 |
| 6,460,984 | B1 | 10/2002 | Matsumoto et al. | 347/86 |
| 6,520,630 | B1 | 2/2003 | Oda et al. | 347/85 |
| 6,773,099 | B2 | 8/2004 | Inoue et al. | 347/86 |
| 6,830,324 | B2 | 12/2004 | Ogura et al. | 347/86 |
| 6,854,836 | B2 | 2/2005 | Ishinaga et al. | 347/85 |
| 6,935,739 | B2 | 8/2005 | Inoue et al. | 347/104 |
| 7,077,514 | B2 | 7/2006 | Inoue et al. | 347/86 |
| 7,104,640 | B2 | 9/2006 | Ogura et al. | |
| 2001/0028374 | A1 | 10/2001 | Ogawa et al. | 347/35 |
| 2003/0035036 | A1 | 2/2003 | Ogura et al. | 347/86 |
| 2004/0061748 | A1* | 4/2004 | Kuwabara et al. | 347/85 |
| 2004/0135854 | A1 | 7/2004 | Kuwabara et al. | 347/85 |
| 2005/0068349 | A1 | 3/2005 | Matusmoto et al. | 347/7 |
| 2005/0068394 | A1* | 3/2005 | Inoue et al. | 347/93 |
| 2005/0270342 | A1 | 12/2005 | Ogura et al. | 347/85 |

FOREIGN PATENT DOCUMENTS

| | | |
|---|---|---|
| JP | 5-96744 | 4/1993 |
| JP | 6-183023 | 7/1994 |
| JP | 10-29318 | 2/1998 |
| JP | 11-309876 | 11/1999 |
| JP | 2001-187459 | 7/2001 |

* cited by examiner

LIQUID SUPPLY SYSTEM, FLUID COMMUNICATING STRUCTURE, INK SUPPLY SYSTEM, AND INKJET RECORDING HEAD UTILIZING THE FLUID COMMUNICATING STRUCTURE

TECHNICAL FIELD

The present invention relates to a fluid communicating structure for supplying a liquid such as an ink to, for example, a recording head or pen as a liquid-consuming section from an ink tank as a liquid containing section with stability and no waste of the liquid and for discharging a gas existing in the liquid-consuming section to the liquid containing section. The invention also relates to a liquid supply system utilizing the structure and an inkjet recording apparatus utilizing the system.

BACKGROUND ART

Recently, apparatus utilizing or consuming a liquid, e.g., inkjet recording apparatus which form an image on a recording medium by applying an ink that is a liquid onto the recording medium using an inkjet recording head are widely used for printing operations including color printing because they make relatively low noises during printing and they are capable of forming small dots with a high density. One type of such inkjet recording apparatus has an inkjet recording head that is supplied with an ink from an ink tank integrally or separably attached thereto, a carriage that carries the recording head and scans the recording head relative to a recording medium in a predetermined direction, and transport means that transports the recording medium relative to the recording head in a direction orthogonal to the predetermined direction (sub-scanning), the apparatus performing recording by ejecting the ink during main scanning of the recording head. In some apparatus, a recording head capable of ejecting a black ink and color inks such as yellow, cyan, and magenta inks is mounted on a carriage to allow not only monochromatic printing of text images using the black ink but also full-color printing through changing of an ejecting ratio among the inks.

In such inkjet recording apparatus, it is important to discharge a gas such as air which is about to enter or has entered an ink supply channel properly.

Gases that can enter a supply system are generally categorized into four types according to factors generating them as follows:

(1) gasses that enter through ink ejection openings or orifices of a print head or gasses generated as a result of an ejecting operation, (2) products of separation of gasses that have dissolved in ink, (3) gasses that enter a supply channel as a result of gas transmission through the material of which the supply channel is made up, (4) gasses that enter when a cartridge type ink tank is replaced.

A liquid path formed in an inkjet recording or print head has a very fine configuration, and ink supplied from an ink tank to the recording head is therefore required to be in a clean condition in which there is no foreign substance such as dust in the ink. Specifically, when foreign substances such as dust have entered, a problem arises in that the foreign substances clog up an ejection opening that is an especially narrow part of an ink channel in the recording head or a part of the liquid path in direct communication with the ejection opening. As a result, an ink ejecting operation can not be performed properly, and the function of the recording head may not be recovered.

Under such circumstances, a configuration is frequently employed in which a filter member for removing foreign substances is provided in an ink supply channel between a recording head and an ink supply needle that is stuck into an ink tank to make it possible to prevent foreign substances from entering the recording head side with the filter member.

Incidentally, there is a recent trend toward greater numbers of ejection openings for ejecting ink in order to achieve recording at higher speeds, and drive signals having higher and higher frequencies are coming into use to be applied to elements for generating energy for ink ejection. This has resulted in an abrupt increase in ink consumption per unit time.

This obviously results in an increase in the amount of ink that passes through a filter member and, in order to reduce pressure loss attributable to a filter member, it is effective to provide a filter member having a large area by enlarging a part of the supply channel. As a result, when bubbles enter the supply channel, they are apt to stay in a space in the enlarged part located upstream of the filter member and will become unremovable, in which state a problem arises in that smooth supply of the ink is hindered. There is another possibility that the gas residing in the supply channel enters the ink led to the ejection opening as microscopic bubbles to cause problems such as disabled ink ejection.

It is therefore strongly desired to remove air residing in an ink supply channel quickly, and there are several solutions to this.

One solution is to perform a cleaning operation as described below.

An inkjet recording head performs printing by ejecting ink that is a liquid, for example, in the form of droplets from an ejection opening that is provided opposite to a recording medium. Therefore, printing may fail for causes such as an increase in ink viscosity or solidification of the ink attributable to evaporation of the ink solvent through the ejection opening, deposition of dust at the ejection opening, and clogging of the ejection opening attributable to invasion of bubbles into a liquid channel inside the ejection opening.

Under such circumstances, an inkjet recording apparatus is equipped with capping means for covering the ejection openings of the recording head during non-printing operations or a wiping member for cleaning the surface of the recording head where the ejection openings are formed (ejection opening forming surface) as occasions demand.

The capping means functions not only as a cover for preventing ink at the ejection opening from being dried as described above when printing is ceased. When the ejection opening is clogged, the capping means covers the ejection opening forming surface with a capping member and exerts a negative pressure, for example, with a suction pump that is in communication with the interior of the capping member to evacuate the ink from the ejection opening, the capping means thus providing the function of eliminating any ink ejection failure attributable to clogging due to solidification of the ink at the ejection opening, the ink with increased viscosity in the liquid path, or bubbles contained therein.

A process of discharging ink by force to eliminate such ink ejection failures is referred to as a cleaning operation, and it is performed when printing is resumed after the apparatus has been out of operation for a long time or when a user notices that the quality of recorded images has deteriorated and operates, for example, a cleaning switch. Further, the process is accompanied by an operation of wiping the ejection opening forming surface with a wiping member constituted by an elastic plate made of rubber after evacuating the ink by force as thus described.

There is another approach in which, at the time of initial charging to charge the flow channel or liquid path of a recording head with ink or at the time of a cleaning operation performed when an ink tank is replaced, a suction pump is driven at a high speed to exert a great negative pressure upon the ejection opening forming surface that is capped and in which a high flow rate is achieved in the ink supply channel to discharge bubbles contained therein.

However, when the surface area of a filter member is increased to suppress a dynamic or kinetic pressure of the filter member as described above, the sectional area of the flow channel also increases. As a result, even when a great negative pressure is generated in the flow channel during the cleaning operation as ascribed above, a flow rate that is high enough to transport bubbles effectively will not be generated, and it is quite difficult to remove the entrapped bubbles from the ejection opening side using a suction pump. That is, the ink must be at a predetermined flow rate when passing the filter as a requirement to be satisfied to allow the bubbles to pass the filter as a result of an ink flow caused by the suction pump, and a great pressure difference must be generated across the filter to generate such a flow rate. This is normally achieved by increasing the resistance of the flow channel through a reduction of the filter surface area or increasing the flow volume of the suction pump. However, when the filter is made smaller, its performance of supplying ink to the head is reduced and, when it is attempted to remove a gas using a high flow volume, a great amount of ink is discharged to result in wasteful consumption of the ink.

Thus, there is left two other possible methods of removing bubbles, i.e., a method in which bubbles are directly discharged to the outside and a method in which bubbles are moved to an ink tank and kept in a part of the tank where they do not hinder the supply of ink. The former method involves a configuration in which a hole for communication to the outside is provided in an ink supply channel, and this method is not preferable for the reasons described below.

In most ordinary inkjet recording apparatus, in order to prevent undesirable leakage of ink through an ejection opening, a capillary force generating member such as an absorber is disposed in an ink tank or a negative pressure is generated in an ink containing space in an ink tank by providing an elastic member such as a spring in an flexible ink containing bag to exert an urging force in the direction of increasing the internal volume of the same. In such cases, when a simple communication hole is provided in the supply channel to remove bubbles, since the negative pressure is canceled by invasion of air through the communication hole, it becomes necessary to dispose a pressure-regulating valve at the communication hole. This is not preferable because the structure of the ink supply system and consequently the structure of a recording apparatus utilizing the same become complicated and large-sized. Further, in order to prevent leakage of ink through the communication hole for removing bubbles, it is required to dispose a water repellent film which allows a gas to pass but disallows a liquid to pass or a device for opening the communication hole only when bubbles are contained to discharge the bubbles (a mechanism for detecting the quantity of bubbles or a mechanism for opening and closing the communication hole). This results in an increasing in the manufacturing cost and a complicated and large-sized structure.

The approach of moving bubbles into an ink tank will now be discussed. In dosing so, it is preferable to be able to transport the ink to the head in a quantity equivalent to the volume of the bubbles or gas to be moved into the ink tank because this will keep the internal volume of the ink tank unchanged and keep a negative pressure generated therein constant to allow a negative pressure, which is in equilibrium with the ability of the recording head to hold meniscus formed at the ejection opening, to be applied to the recording head. In the case of a cartridge type ink tank, since it is replaced with new one when the ink contained there is runs out, the ink tank can be regarded as having a configuration which allows a gas to be completely eliminated from the ink supply system.

In popular inkjet recording apparatus for consumers, however, a configuration is frequency employed in which cartridge type ink tanks containing a black ink and color inks, respectively, can be detachably mounted on a recording head or a carriage mounting the head from above the same. Specifically, many of the cartridges are configured so that they are stuck by hollow ink supply needles mounted on the carriage with their points directed upward to allow the inks to be supplied to a recording head. Therefore, attention is to be paid on the inner diameter of the ink supply needles that connect the ink cartridges and the recording head. Specifically, while it is desired to use thin supply needles to allow a cartridge mounting operation to be easily performed without requiring a great force, a reduction in the inner diameter of the needles disallows smooth movement of bubbles because of a corresponding increase in meniscus force.

Several proposals have been made on the mechanism for moving a gas into an ink tank.

For example, in Japanese Patent Application Laid-open No. 5-96744(1993), a configuration is disclosed in which a recording head is separated into a first chamber having an atmosphere communication hole and a second chamber having a capillary force generating member and in which the first chamber and an ink tank are connected through two or more communication channels that open into the first chamber at different elevations to supply air into the ink tank through one of the communication channel. In such a configuration, since a negative pressure is exerted on a print head by a difference between water heads in the first and second chambers or the capillary force generating member provided in the second chamber, the atmosphere communication hole is provided at the first chamber.

However, the configuration of the aforementioned reference is aimed at introducing atmosphere into the ink tank in accordance with the supply of the ink in order to use up the ink in the ink tank that is not deformed and is not aimed at discharging bubbles contained in the ink supply channel into the ink tank. That is, the technique disclosed in this application cannot be used to transport a gas from the ink supply channel especially the second chamber or recording head to the ink tank.

As another proposal, Japanese Patent Application Laid-open No. 11-309876(1999) discloses a configuration in which a gas-preferring introduction channel and a liquid delivery channel are provided at a communication section for connecting a chamber for containing a negative pressure generating member and a liquid containing chamber that are separable from each other to ensure that a gas is introduced into the liquid containing chamber. However, this application also discloses a configuration wherein a capillary force generating member and an atmosphere communication hole are provided between an ink tank and a recording head, the configuration represents an open type ink supply channel to and from which a gas freely enters and exits through an opening as the atmosphere communication hole as seen in Japanese Patent Application Laid-Open No. 5-96744(1993). The technique discloses in the same application cannot be used to eliminate bubbles entrapped in an ink supply channel.

Further, U.S. Pat. No. 6,347,863 discloses an ink container 50 formed with a drain conduit 66, 72 or 74 and a vent conduit 76, 82 or 84 that protrude from the bottom of the container and describes a configuration in which an upper opening of the drain conduit is located on the bottom of an inner wall of the container and in which an opening of the vent conduit is located in a containing space of the container. The technique disclosed in this document is aimed at configuring a system for refilling a member 14 having a reservoir 16, 18 or 20 with ink and is not aimed at removal of bubbles entrapped in an ink supply channel downstream of the reservoir or in a section that uses the ink. Since lower openings of the drain conduit and the vent conduit are at the same elevation, there is a possibility that movement of a liquid and gas is disabled when meniscuses are formed in the conduits. Further, there is no description of an atmosphere communicating hole in this document, in a state that a system composed of ink container (50) and pressure plates (14) is closed, the inner negative pressure abruptly increases while a continuous use of ink, resulting in a disable supply of the ink to the ink-consuming section. In view of the aforementioned, it is considered the atmosphere communication hole is provided with any part of the system. Considering a disclosure that reservoir (16, 18, 20) is filled with foam (90), and a configuration and functions of the gas-preferring introduction channel, the ink container (50) shown in FIG. 2 of this document and the like, it is assumed that the atmosphere communication hole is placed at a side of the reservoir (16, 18, 20). In any case, there is no perspective that a positive elimination of bubbles remaining in the ink supplying channel is performed due to the above-mentioned 1) to 4).

Further, Japanese Patent Application Laid-open No. 10-29318(1998) discloses a configuration in which a replenishing tank for replenishing a reservoir tank with ink can be coupled to the tank that has a chamber containing a negative pressure generating member and an ink containing chamber and in which, when the replenishing tank is coupled to the ink containing section in an upper part and a lower part of the same, the ink is introduced into the ink containing chamber from the replenishing tank through a liquid communication pipe associated with the lower part, and air is introduced into the replenishing tank from the ink containing chamber through a gas communication pipe associated with the upper part. However, the application is not essentially different from Japanese Patent Application Laid-open No. 5-96744(1993) and Japanese Patent Application Laid-open No. 11-309876(1999) in the configuration in which a negative pressure generating member and an atmosphere communication hole are provided between an ink containing chamber and a recording head. The technique discloses in the same application cannot be used to eliminate bubbles entrapped in an ink supply channel.

Japanese Patent Application Laid-open No. 2001-187459 discloses a configuration as shown in FIG. 23 in which a sub-tank 1022 for replenishing a main tank 1020 in communication with a recording head 1018 with ink is attached to an upper part of the main tank to introduce a gas in the main tank into the sub-tank and to supply the ink in the sub-tank into the main tank through acceleration and deceleration of a carriage. According to the application, the main tank section has means for introducing, atmosphere although the main tank section in communication with the sub-tank contains the ink in a free state or directly, which configuration is not essentially different from those in Japanese Patent Application Laid-open Nos. 5-96744(1993), 11-309876(1999), and 10-29318(1998). That is, the proposal lacks the viewpoint of positive elimination of bubbles entrapped in an ink supply channel due to the above (1) to (4).

The configurations in Japanese Patent Application Laid-open Nos. 5-96744(1993), 11-309876(1999), 10-29318 (1998), and 2001-187459 are similar in that a separable liquid containing section (ink tank) is in communication with a recording head through a plurality of communication channels and in that atmosphere introducing means is provided downstream of the communication channels (on the recording head side of the channels). Problems with this configuration will be described below with reference to Japanese Patent Application Laid-open No. 2001-187459 as a typical example.

FIG. 23 is a conceptual diagram for explaining the invention disclosed in the Japanese Patent Application Laid-open No. 2001-187459. A discussion will be made on balance among forces acting on the region of a meniscus formed in a pipe 1056A on an assumption that movement of air (movement of air into a sub ink chamber 1081 of a sub tank 1022 through the pipe 1056A) has stopped in the illustrated state. First, there are forces acting downward, i. e., a pressure HA originating from a water head difference between the level of ink in the sub ink chamber 1081 and the position of the meniscus that is formed at an opening of the pipe 1056A and a pressure MA originating from meniscus force. Further, there is a force acting upward, i.e., a pressure P originating from air stored in an ink bag 1100 that is disposed in a main tank 1020. All of those forces or pressure have come to a balance to stop the movement of air. In this case, the pressure P of the air is balanced with a sum of the pressure originating from the water head difference between the level of the ink in the sub ink chamber 1081 and the position of the level of the ink in the ink bag 1100 and the pressure originating from the meniscus force (P=HA+MA). Further, since the ink in the sub ink chamber 1081 and the ink in the ink bag 1100 are in communication with each other, a difference HB−HA between the downward ink pressure acting on the meniscus formed at the pipe 1056A and the pressure of the gas in the ink bag 1100 is equal to the pressure HB−HA originating from the water head difference between the position of the meniscus at the pipe 1056A and the level of the liquid in the ink bag 1100. The balance between the pressure originating from the water head difference HB−HA and meniscus pressure MA has consequently brought about an equilibrium state.

When the level of the liquid in the ink bag 1100 is lowered from the state as a result of introduction of bubbles from a bubble generator 1104 by consumption of ink, the pressure HA−HA originating from the water head difference between the position of the meniscus at the pipe 1056A and the level of the liquid in the ink bag 1100 increases. When the pressure exceeds the meniscus pressure, air is introduced into the sub ink tank 1081, and the ink in the sub ink chamber 1081 is supplied to the ink bag 1100 accordingly.

When the ink is ejected at a recording head 1018, however, since a flow of ink occurs throughout the supply system, a pressure loss in accordance with the ink flow rate or volume in the pipe 1056B occurs between the sub ink chamber 1081 and the ink bag 1100. This results in a need for taking the pressure loss into consideration in reviewing the above-described relationship between the meniscus pressure and the pressure originating from the water head difference between the meniscus position and the level of the liquid in the ink bag 1100. Consequently, movement of air occurs when the pressure originating from the water head difference between the meniscus position and the level of the liquid in the ink bag 1100 is greater than a pressure that is obtained by reflecting the pressure loss in the above-described meniscus pressure. That is, unlike the state in which movement of air has been stopped, no gas-liquid exchange occurs in an ink-ejecting state or a dynamic state unless the liquid level is further lowered in a quantity corresponding to the pressure loss at the pipe 1056B in accordance with the ink flow rate. When the liquid level at which the gas-liquid exchange to be started becomes lower than the opening of the pipe 1056B, no gas-liquid exchange occurs, and the ink in the main tank 1020 is used up with the ink in the sub tank 1022 left unused.

Therefore, when the pipe is made thin to facilitate the tank mounting operation as described above, the pressure loss increases accordingly, and attention must be paid on the fact that the liquid level at which gas-liquid exchange in the main tank is to be started becomes lower accordingly. That is, it becomes inevitable to increase the size of the main tank, which results in an increase in the size of the recording apparatus as a whole.

Another problem with the configuration as shown in FIG. 23 is the fact that the bubble generator 1104 is disposed in a lower part of the ink tank. Specifically, while it is strongly desirable to minimize transportation of bubbles to the ink ejection opening, as an ink ejecting operation proceeds, bubbles introduced from the bubble generator 1104 can be entrained by the flow of ink toward the recording head 1018 to enter a flow channel 1041 in communication with the recording head 1018. Therefore, in order to prevent such entrainment of bubbles, it is necessary to take measures such as limiting the flow of ink accompanying the ink ejecting operation and disposing the bubble generator 1104 in a position apart from a filter section 1039, which results in a further increase in the size of the main tank 1020.

Those problems are similarly encountered in the configurations in Japanese Patent Application Laid-open Nos. 5-96744(1993), 11-309876(1999), and 10-29318(1998) that are configurations including atmosphere introducing means provided on the recording head side of the communication channel.

DISCLOSURE OF THE INVENTION

As described above, although the above-cited documents refer to introduction of a gas into an ink tank located at an upper end of a stream, none of them serves the purpose of transporting a gas entrapped in an ink supply channel that is a closed structure when used, i.e., a gas that enters and stays in the channel for the reasons described in the above (1) to (4), into an ink tank smoothly and keeping it in the tank.

Therefore, in a liquid supply system having a structure that is closed relative to a liquid-using section, it is an object of the invention to make it possible to eliminate a gas that hinders an operation utilizing a liquid and an operation of supplying the liquid from the liquid-using section quickly and smoothly without making the structure complicated.

It is another object of the invention to provide an inkjet recording apparatus in which a gas entrapped in an ink supply channel having a closed structure is smoothly and quickly transported to an ink tank and in which problems attributable to entrapped bubbles, i.e., failures of recording attributable to a failure of ink supply and clogging of an ejection opening by entrapped bubbles, do not occur when the recording apparatus is actually used.

In a first aspect of the present invention, there is provided a liquid supply system, comprising:

a liquid consuming section for consuming a liquid;

a liquid chamber communicating with the liquid consuming section;

a liquid containing section for containing the liquid; and plural communication channels for providing communication between the liquid chamber and the liquid containing section, wherein the liquid chamber forms a substantial closed space except the plural communication channels and the liquid consuming section, and the liquid containing section has means for adjusting a pressure inside the system.

In a second aspect of the present invention, there is provided a fluid communication structure for providing fluid communication between a liquid containing section for containing a liquid and a liquid consuming section for consuming the liquid, the fluid communication structure comprising:

a liquid chamber communicating with the liquid consuming section; and plural communication channels for providing communication between the liquid chamber and the liquid containing section, wherein the liquid chamber forms a substantial closed space except the plural communication channels and the liquid consuming section, and in a state where a gas exists inside the closed space, the gas can be transferred to the liquid containing section via a part of the plural communication channels.

In a third aspect of the present invention, there is provided an ink supply system, comprising:

a recording head for ejecting an ink;

a liquid chamber communicating with the recording head;

an ink tank for containing the ink; and plural communication channels for providing communication between the liquid chamber and the ink tank, wherein the liquid chamber forms a substantial closed space except the plural communication channels and the recording head, and the ink tank has means for adjusting a pressure inside the system.

In a fourth aspect of the present invention, there is provided an ink supply system, comprising:

a recording head for ejecting an ink;

a liquid chamber communicating with the recording head;

an ink tank for containing the ink; and plural communication channels for providing communication between the liquid chamber and the ink tank, wherein the liquid chamber forms a substantial closed space except the plural communication channels and the recording head, and on ejecting of the ink from the recording head, atmosphere is introduced into the ink tank with liquid chamber side opening portions of the plural communication channels being in contact with the ink.

In a fifth aspect of the present invention, there is provided an ink tank that is connected via plural communication channels to a liquid chamber communicating with a recording head for ejecting an ink and thereby comes into fluid communication with the liquid chamber, the liquid chamber forming a substantial closed space except the plural communication channels and the recording head, the ink tank comprising means for adjusting a pressure inside an ink supply system for supplying the ink to the recording head.

In a sixth aspect of the present invention, there is provided an inkjet recording head for ejecting an ink to thereby perform recording, the inkjet recording head having the fluid communication structure as described above integral therewith.

In a seventh aspect of the present invention, there is provided an inkjet recording apparatus, wherein an ink supply system as described above is used to perform recording as holding the ink supply system such that the liquid chamber is positioned substantially above the recording head and the ink tank is positioned substantially above the liquid chamber, in terms of their positions in use, with reference to a vertical direction.

In an eighth aspect of the present invention, there is provided an ink supply system, comprising:

a recording head for ejecting an ink;

a liquid chamber communicating with the recording head;

an ink tank for containing the ink;

plural communication channels for providing communication between the liquid chamber and the ink tank; and means for introducing atmosphere directly into the ink tank without via the liquid chamber.

In a ninth aspect of the present invention, there is provided an ink tank that is connected via plural communication channels to a liquid chamber communicating with a recording head for ejecting an ink and thereby comes into fluid communication with the liquid chamber, the ink tank comprising:

means for introducing atmosphere directly into the ink tank without via the liquid chamber; and means for adjusting a pressure inside an ink supply system for supplying the ink to the recording head.

According to the invention, in the liquid supply system having the closed structure to a liquid-consuming section, a gas that hinders a liquid consuming operation and a liquid supply operation is rapidly and smoothly eliminated from the liquid-consuming section without involving any complication in structure.

Besides, when the invention is applied to the inkjet recording apparatus, a gas remaining in the ink supply channel having the closed structure is smoothly and rapidly transferred to the ink tank side. Moreover, even in actual use of the recording apparatus, it is possible to prevent a problem resulting from stagnant air bubbles, i.e., a recording defect resulting from poor ink supply, clogging of the ejection openings caused by mixed-in air bubbles, or the like.

Besides, when an ink including a pigment as a coloring material is used, the sedimentation of pigment particles is dispersed when air is transferred to the tank, thus enabling securement of ink storing stability and ejection reliability.

As aforesaid, according to the invention in which ink can be supplied with a negative pressure applied to the head being stabilized, printing performance and reliability and a reduction in cost can be simultaneously realized.

The above and other objects, effects, features and advantages of the present invention will become more apparent from the following description of embodiments thereof taken in conjunction with the accompanying drawings.

BEST MODE FOR CARRYING OUT THE INVENTION

Several embodiments of the invention in an inkjet recording apparatus will now be described with reference to the drawings.

In the present specification, the term "recording" implies not only forming meaningful information such as characters and graphics but also forming, on recording media, images, figures, and patterns in a broad sense regardless of whether or not they are meaningful and whether or not they are manifested to be visually perceivable to a man or processing the recording media to form them.

While the term "recording media" implies not only paper that is used recording apparatus in general but also a variety of objects that can accept inks such as cloth, plastic films, metal sheets, glass, ceramics, wood, and leathers, the term "paper" will be used in the following.

While the following embodiments will be described on an assumption that ink is used as a liquid in a liquid supply system according to the invention by way of example, it is obvious that usable liquids are not limited to inks and include liquids for processing recording media in the field of inkjet recording, for example.

First Embodiment

Figure 1:
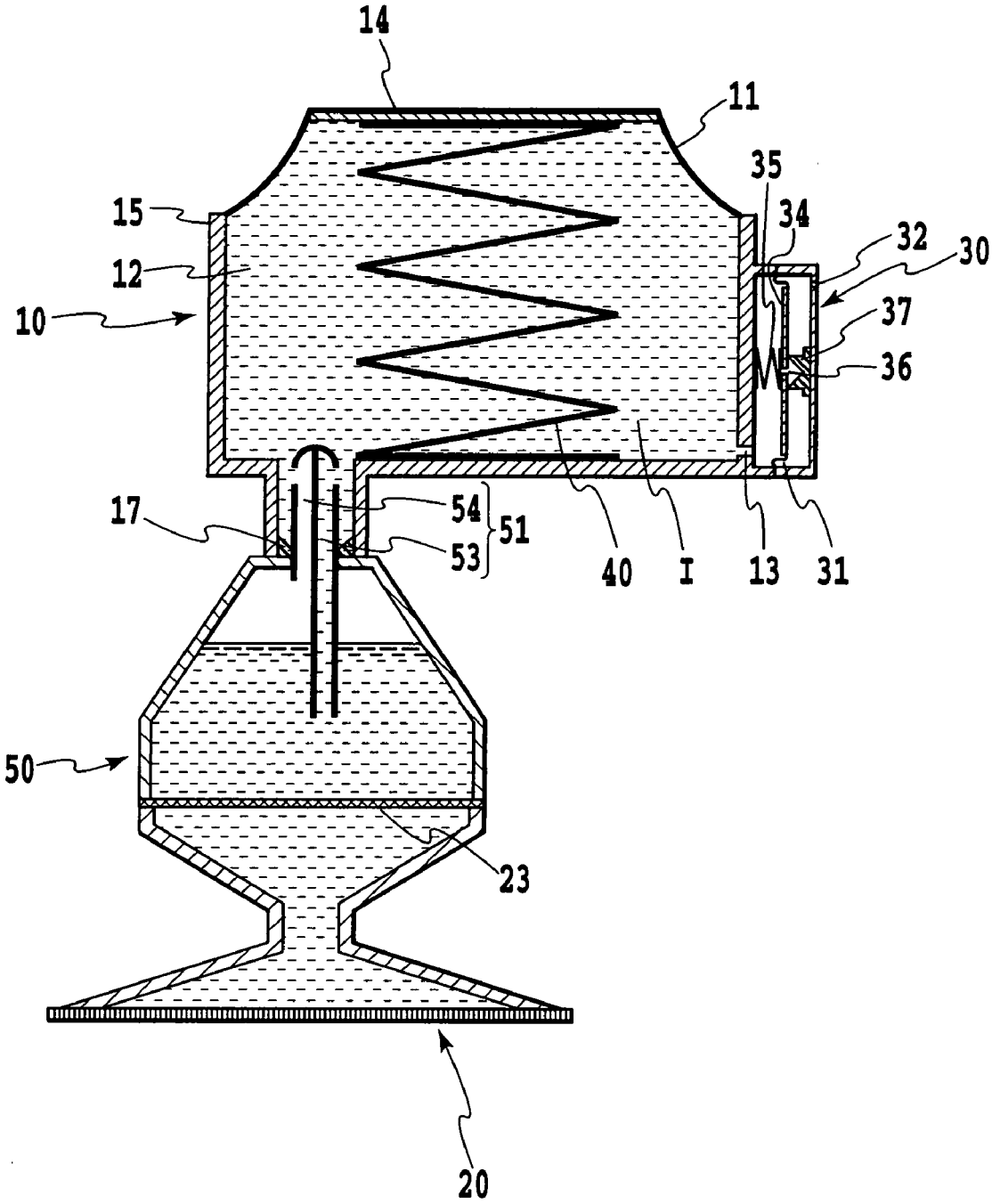
FIG. 1 is a schematic sectional view of a liquid supply system according to a first embodiment of the invention.

FIG. 1 is a schematic sectional view of a liquid supply system according to a first embodiment of the invention.

Briefly, the ink supply system of the embodiment shown in FIG. 1 comprises an ink tank 10 as a liquid container, an inkjet recording head (hereinafter simply referred to as "recording head") 20, and a liquid chamber 50 that forms an ink supply channel for communication between them. The liquid chamber 50 maybe separably or inseparably integrated with the recording head 20. The liquid chamber 50 may be provided on a carriage that carries the recording head 20 such that the ink tank 10 can be attached and detached to and from the same from above and may close the ink supply channel extending from the ink tank 10 to the recording head 20 when it is mounted. The liquid chamber 50 forms a substantially closed space except for portions to connect the ink tank 10 and the recording head 20 and does not have means for introducing atmosphere.

Schematically, the ink tank 10 comprises two chambers, i.e., an ink containing chamber 12 in which an ink containing space is defined and a valve chamber 30. The interiors of those chambers are in communication with each other through a communication channel 13. Ink to be ejected from the recording head is contained in the ink containing chamber 12 and is supplied to the recording head as an ejecting operation proceeds.

A flexible film (sheet member) 11 that can be deformed is disposed in a part of the ink containing chamber 12, and a space for containing the ink is defined between the part and a inflexible outer casing 15. The space outside the ink containing space as viewed from the sheet member 11, i.e., the space above the sheet member 11 in the figure is open to the atmosphere and is therefore under the same pressure as the atmospheric pressure. Further, the ink containing space is a substantially closed space except for a portion to connect a connecting section 51 of the liquid chamber 50 provided under the same and the communication channel 13 to the valve chamber.

The shape of a central portion of the sheet member 11 of the present embodiment is regulated by a pressure plate 14 that is a support member in the form of a flat plate, and peripheral portions of the same are deformable. The sheet member 11 is formed in a convex shape in the central portion thereof in advance, and the side geometry of the same is substantially trapezoidal. As will be described later, the sheet member 11 is deformed in accordance with changes in the amount of ink in the ink containing space and changes in the pressure in the chamber. On such occasions, the peripheral portions of the sheet member 11 undergo well-balanced expansion and contraction, and the central portion of the sheet member 11 undergoes upward and downward translation in the figure while being kept in a substantially horizontal attitude. Since the sheet member 11 is smoothly deformed (moved) as thus described, no shock occurs in association with the deformation, and no abnormal pressure change attributable to shock occurs in the ink containing space.

In the ink containing space, there is provided a spring member 40 in the form of a compression spring which exerts an urging force to urge the sheet member 11 upward in the figure through the pressure plate 14 and which thereby generates a negative pressure relative to an atmosphere pressure in such a range that the recording head can perform an ink ejecting operation in equilibrium with a force to hold meniscuses formed at an ink ejecting section of the recording head. In addition, any change in the volume of air in the ink containing chamber as a result of a change in the environment (ambient temperature or atmospheric pressure) is accommodated by displacement of the spring and the sheet, so that the negative pressure in the chamber will not change significantly. While FIG. 1 shows a state in which the ink containing space is substantially completely filled with ink, the spring member 40 is compressed even in this state to generate a proper negative pressure in the ink containing space.

In the valve chamber 30, a one-way valve is provided for introducing a gas (air) from the outside when the negative pressure in the ink tank 10 increases to a predetermined value or higher and preventing leakage of the ink from the ink tank 10. The one-way valve comprises a pressure plate 34 which has a communication hole 36 and serves as a valve closing member, a seal member 37 which is secured to an inner wall of the valve chamber housing in a position opposite to the communication hole 36 and which is capable of sealing the communication hole 36, and a sheet member 31 which is bonded with the pressure plate and through which the communication hole 36 extends. Thus, a substantially closed space is maintained also in the valve chamber 30 except for the communication hole 13 to the ink tank 10 and the atmosphere communication hole 36. The space in the valve chamber housing located on the right side of the sheet member 31 in the figure is open to the atmosphere through an atmosphere communication hole 32 and is therefore under the same pressure as the atmospheric pressure.

Peripheral portions of the sheet member 31 other than the portion bonded with the pressure plate 34 in the central portion thereof are deformable. The member has a convex shape in the central portion thereof and has a side geometry that is substantially trapezoidal. By employing such a configuration, the pressure plate 34 that is a valve closing member is smoothly moved to the left and right in the figure.

In the valve chamber 30, there is provided a spring member 35 as a valve regulating member for regulating a valve opening operation. The spring member 35 is also in a compressed state, and a configuration is employed in which a reaction force against the compression urges the pressure plate 34 to the right in the figure. As a result of the expansion and compression of the spring member 35, the seal member 37 seals and leaves the communication hole 36 to function as a valve, and it also acts as a one-way valve mechanism that allows only introduction of a gas from the atmosphere communication hole 32 into the valve chamber 30 through the communication hole 36.

What is required for the seal member 37 is to ensure that the communication hole 36 is sealed. Specifically, any member capable of maintaining a sealed state may be employed including those configured such that at least a part of the same in contact with the communication hole 36 is kept flat relative to the opening, those having a rib that can be put in contact with the area surrounding the communication hole 36, and those configured such that an end of the same can be stuck into the communication hole 36 to close the communication hole 36. There is no particular limitation on the material for the member. However, since the sealing is achieved by the expanding force of the spring member 35, the seal member is more preferably formed of an element that easily follows the sheet member 31 and the pressure plate 34 that are moved by the expanding force acting thereon, i.e., a contractible elastic element such as rubber.

When the ink tank 10 is configured as described above, each part of the same is designed such that the communication hole 36 is opened to cause an inflow of the atmosphere into the ink containing chamber at the instant when ink consumption further continues to increase the negative pressure in the ink containing chamber 12 from an equilibrium state between the negative pressure and the force exerted by the valve regulating member in the valve chamber 30 which has been reached by the progress of ink consumption since an initial state in which the tank was sufficiently filled with the ink. Since the introduction of the atmosphere allows the internal volume of the ink containing chamber 10 to increase conversely because the sheet member 11 or the pressure plate 14 can be displaced upward in the figure, and the negative pressure simultaneously decreases to close the communication hole 36.

Even when there is a change in the environment of the ink tank, e.g., a temperature rise or a pressure reduction, since the air that has been introduced into the containing space is allowed to expand in a quantity equivalent to the volume of the tank between a position of the sheet member 11 or the pressure plate 14 reached by its maximum downward displacement and an initial position of the same, i.e., since a space corresponding to the volume functions as a buffer area, a pressure increase attributable to the change in the environment can be moderated to prevent leakage of the ink from the ejection opening effectively.

Since no outside air is introduced until the buffer area is provided through a reduction of the internal volume of the ink containing space as a result of delivery of the liquid from the initial charged state, no leakage of the ink hard to occur even if there is an abrupt change in the environment or even if the ink tank or apparatus is vibrated or dropped until that time. Further, the buffer area is not provided in advance in a state in which no ink has been used, the ink container can be provided with high volumetric efficiency and a compact configuration.

While the spring 40 in the ink containing chamber 12 and the spring 35 in the valve chamber 30 are schematically shown in the form of coil springs in the illustrated example, other types of springs may obviously be used. In particular, conical springs or plate springs may be used, for example. When plate springs are used, they may be provided by combining a pair of plate spring members having a substantially U-shaped sectional configuration such that open ends of the U-like shapes are associated with each other.

In the illustrated embodiment, the recording head 20 and the ink tank 10 are coupled by inserting the connecting section 51 of the liquid chamber 50 provided integrally with the recording head into the ink tank 10. That is, in the present embodiment, the liquid chamber having the connecting section 51 forms a fluid communicating structure and establishes fluidic coupling between them to allow the ink to be supplied to the recording head 20. A sealing member 17 such as rubber is attached to an opening of the ink tank into which the connecting section 51 is inserted to seal the circumference of the connecting section 51, thereby preventing leakage of the ink from the ink tank 10 and ensuring the connection between the connecting section 51 and the ink tank 10. Slits or the like may be formed on the sealing member 17 in the inserted position of the same to facilitate the insertion of the connecting section 51. When the connecting section 51 is not inserted, the slits are closed by an elastic force of the sealing member 17 itself to prevent leakage of the ink.

The connecting potion 51 is a member, in the form of a hollow needle, the interior of which is divided into two parts in the axial direction of the portion. A configuration is employed in which the positions of openings located at the tops of the respective hollow sections, i.e., located inside the ink containing chamber 12 (hereinafter referred to as "tank side opening positions") are at substantially the same elevation in the vertical direction and in which the positions of openings located at the bottoms of the respective hollow sections, i.e., located inside the liquid chamber connected to the head (hereinafter referred to as "head side opening positions") are at different elevations. Hereinafter, for convenience, the flow channel whose head side opening position in the liquid chamber 50 is relatively lower in the vertical direction (the right flow channel in the figure) is referred to as "ink flow channel 53", and the flow channel whose head side opening position is higher in the vertical direction (the left flow channel in the figure) is referred to as "air flow channel 54". However, the designation is based on the fact that the ink is delivered to the recording head primarily through the ink flow channel 53 and air is transported to the ink tank through the air flow channel 54 in a bubble eliminating process, and both of the ink and air may move in each flow channel in practice as will be described later. That is, the names of the flow channels do not mean that they are to be exclusively used for the respective fluids.

The ink supply channel in the liquid chamber 50 has a section which gradually increases from its size on the side of the portion connected to the ink tank 10 (upstream) and which gradually decreases toward the recording head 20 (downstream). The filter 23 is provided at the portion where the ink supply channel is enlarged to the maximum to prevent impurities included in the supplied ink from flowing into the recording head 20. A gas-liquid interface in the liquid chamber 50 formed by a gas staying therein is greater than the sectional areas of the flow channels 53 and 54 in the horizontal direction. As a result, when a water head difference of the ink in the ink tank 10 acts on the ink in the liquid chamber 50 through the flow channel 53, the pressure of the gas existing in the liquid chamber 50 is increased to allow the gas to be discharged toward the ink tank 10 through the air flow channel 54. This effect is made more significant by the configuration in which the ink supply channel in the liquid chamber 50 gradually expands from its size on the side of the portion connected to the ink tank 10 (upstream), i.e., the channel has an upwardly diminishing taper, to make bubbles apt to gather around the head side opening position of the air flow channel 54.

The recording head 20 is provided with a plurality of ejection openings arranged in a predetermined direction (for example, a direction different from the moving direction of the recording head when the serial recording method is employed in which the head is mounted on a member such as a carriage to perform an ejecting operation while moving relative to a recording medium as described later), a liquid path in communication with each of the ejection openings, and elements provided in the liquid paths for generating energy used for ejecting ink. There is no particular limitation on the method of ejecting ink from the recording head or the type of the energy generating elements. For example, electrothermal transducers that generate heat in response to energization may be used as such elements to utilize thermal energy generated by them for ejecting the ink. In this case, film boiling is caused at the ink by the heat generated by the electrothermal transducer, and the ink can be ejected from the ink ejection openings using the foaming energy. Alternatively, electromechanical transducers such as piezoelectric elements which are deformed in response to the application of a voltage may be used to utilize their mechanical energy for ejection of the ink.

The recording head 20 and the liquid chamber 50 may be separably or inseparably integrated, and they may alternatively be configured as separate bodies that are connected through a communication channel. When they are integrated, they may be in the form of a cartridge that can be attached and detached to and from a member (e.g., a carriage) provided in the recording apparatus.

A process of removing bubbles or gas into the ink tank of the present embodiment having the above-described configuration will be described with reference to FIGS. 2 to 7.

Figure 2:
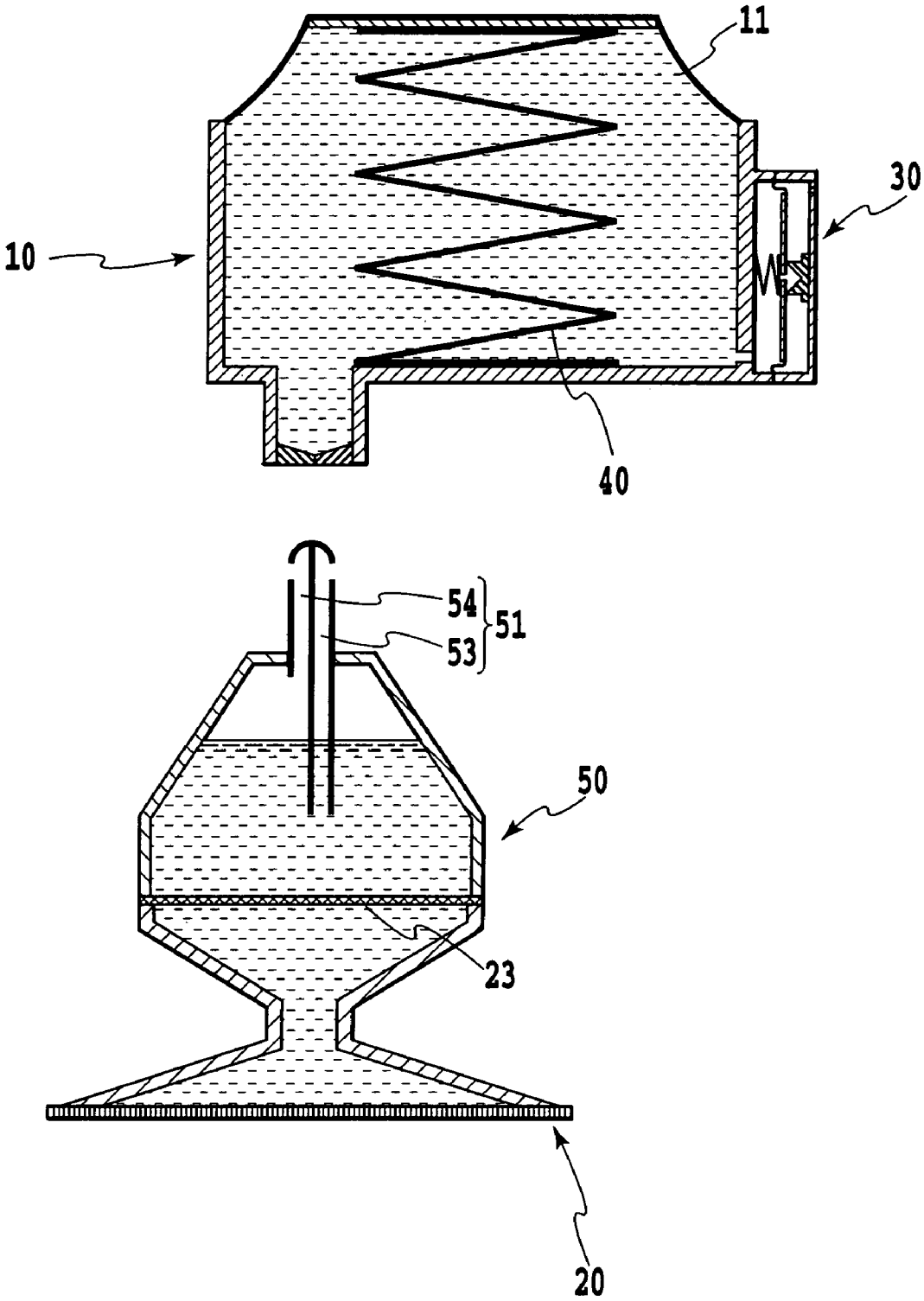
FIG. 2 is a schematic sectional view showing a state in which a new ink tank has not yet been attached to a liquid chamber or a recording head, for explaining a gas removal process of the first embodiment.

FIG. 2 shows a state in which a new ink tank 10 has not been attached to the liquid chamber 50 or the recording head 20 yet. The ink tank 10 is completely charged with ink I, in which state a negative pressure is generated in the same by the spring member 40 and the sheet member 11 bulges toward the outside of the ink tank. Referring to the state of the recording head 20, since recording has been performed using the ink left in the liquid chamber 50 after the ink tank 10 mounted therein ran out, air has entered from the ink tank and has accumulated in an upper part of a region of the liquid chamber 50 located upstream of the filter 23.

In this state, since the upper openings of the connecting section 51 are open to the atmosphere, the ink can leak out from an ink ejection opening nozzle section of the recording head 20 for ejecting the ink when a pressure originating from a water head difference between the ink level in the liquid chamber 50 and that in the nozzle section is greater than a meniscus holding force of the nozzle section. The leakage of the ink is prevented by employing such a design that the pressure originating from the water head difference will not exceed the meniscus holding force. Referring to a specific example of a design to prevent leakage of the ink from the nozzle section regardless of the amount of the residual ink in the liquid chamber 50 or the elevation of the ink level, a design may be employed in which the distance in the vertical direction between the upper openings of the connecting section 51 and the nozzles is determined such that the pressure originating from the water head difference when the ink is filled between the upper openings and the nozzles does not exceed a holding force of the ink meniscuses formed at the nozzle section. According to the invention, since the liquid chamber 50 is not configured to introduce air therein as will be described below, the liquid chamber 50 is provided with a compact configuration, and designing may therefore be carried out with increased freedom to prevent leakage of the ink effectively and simply.

Figure 3:
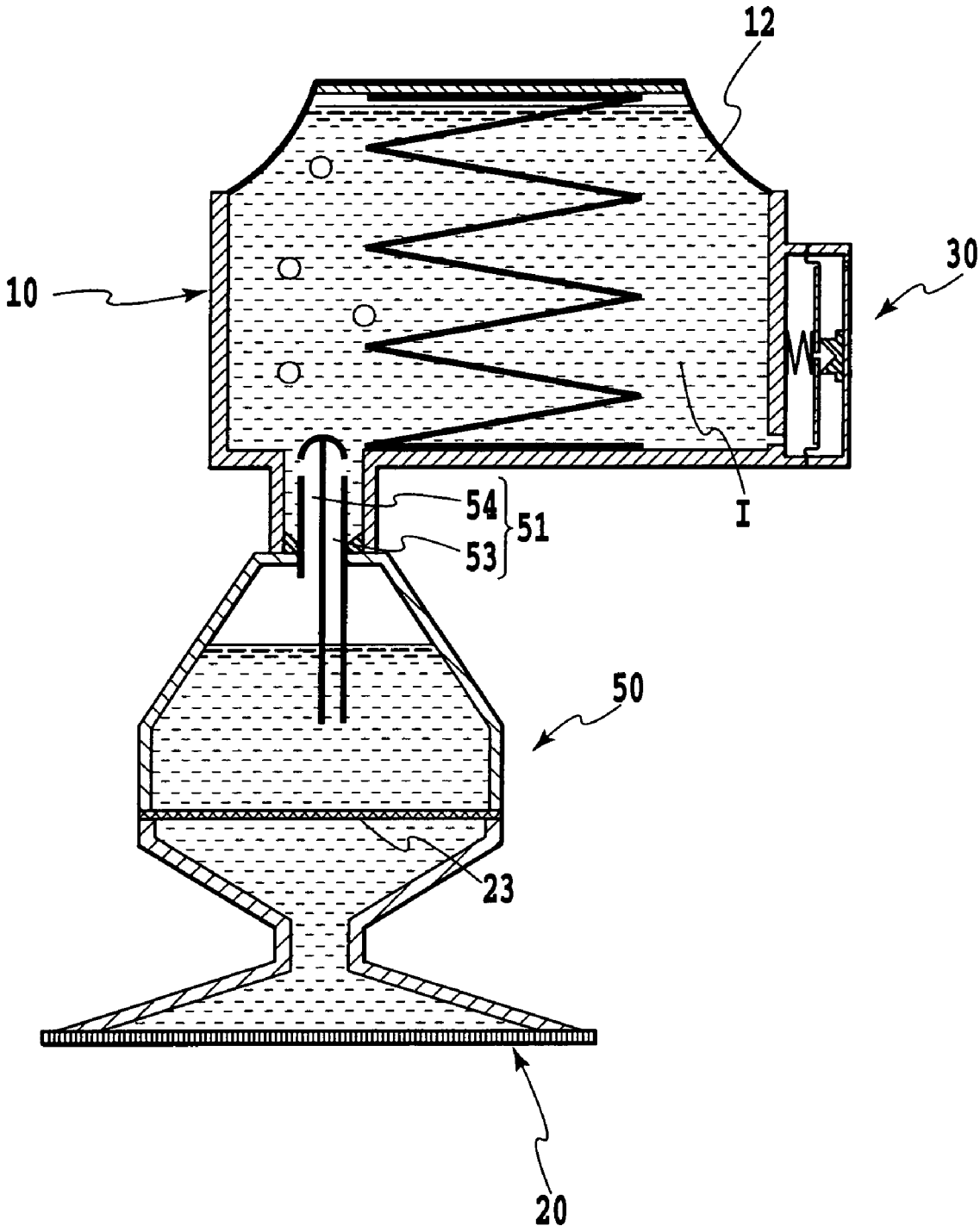
FIG. 3 is a schematic sectional view showing an instantaneous state, following the state of FIG. 2, in which a new ink tank is attached, for explaining a gas removal process of the first embodiment.

FIG. 3 shows a state that immediately follows the mounting of a new ink tank 10 carried out in the state shown in FIG. 2. Before the ink tank is mounted, since the recording head 20 or the liquid chamber 50 is open to the atmosphere, the pressure of the gas in the region upstream of the filter 23 is equal to the atmospheric pressure. On the contrary, the interior of the ink tank is at a pressure (negative pressure) lower than the atmospheric pressure because of the spring member 40. As a result, a part of the gas in the region upstream of the filter 23 moves into the ink containing chamber 12 at the instant when the ink tank 10 is mounted, and the gas resides in an upper part of the tank to equalize the pressures in the ink containing chamber 12 and the liquid chamber 50. However, the ink forms a meniscus in each of the ink flow channel 53 and the air flow channel 54 of the connecting section 51, and the meniscus stop the movement of the gas when the pressures are balanced. While the removal of the gas may be completed depending on the volume of the gas in the liquid chamber, the gas in the illustrated case has a great volume, i.e., the gas to be removed still remains.

Figure 4:
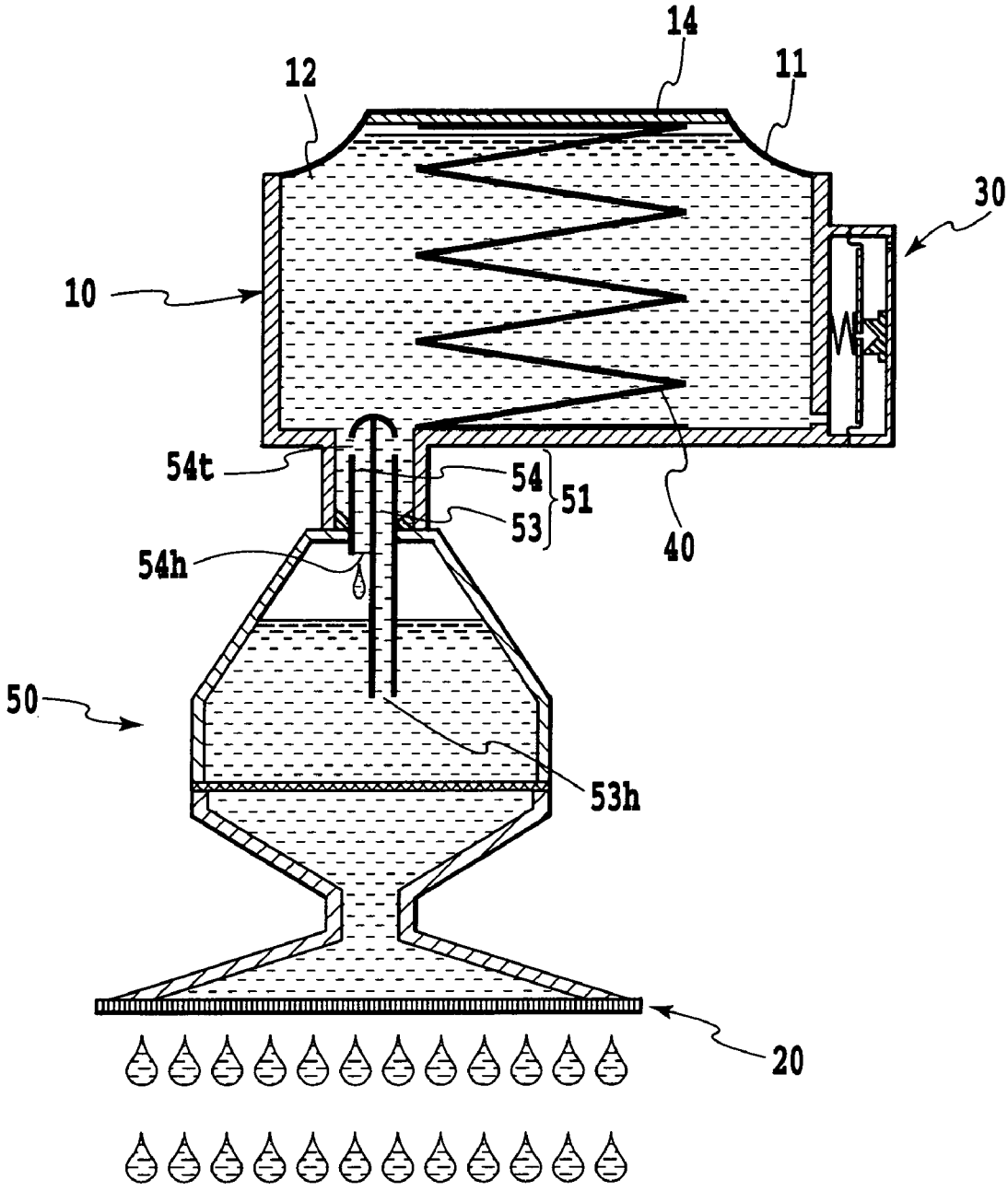
FIG. 4 is a schematic sectional view showing a state in which ink is ejected from the recording head, for explaining a gas removal process of the first embodiment.

FIG. 4 schematically shows ejection of the ink from the recording head 20 in the form of droplets, for example. When the ink is ejected, the negative pressure in the recording head 20 or the liquid chamber 50 increases to break the meniscuses formed at the connecting section 51, which results in a movement of the ink from the ink tank toward the liquid chamber 50. Accordingly, the internal volume of the ink containing chamber 12 decreases, and the sheet member 11 is deformed downward while being limited by the pressure plate 14. The spring member 40 is thus compressed to increase the negative pressure in the ink containing chamber 12.

In the present embodiment, the diameters of the ink flow channel 53 and the air flow channel 54 are substantially equal to each other, and the ink is supplied from each of the flow channels because there is not such a large difference in pressure losses between the flow channels relative to the negative pressure in the recording head 20 or the liquid chamber 50. In the illustrated state wherein a head side opening **53*h* of the ink flow channel 53 is in contact with the ink, the ink flows through the ink flow channel 53 as it is, and bubbles generated in the liquid chamber 50 or the recording head 20 move into the region upstream of the filter and stay in the same region, i.e., the upper part of the liquid chamber 50 along with the gas that has already resided therein. In this state, while the ink forms a meniscus at the position of a head side opening 54*h* of the air flow channel 54, the ink will drop if the negative pressure in the recording head 20 or the liquid chamber 50 is high. While the connecting section 51 is filled with the ink as a result of the ejection of the ink associated with a recording operation or the ejection of the ink performed by an operation other than the recording operation (preliminary ejection) in the present embodiment, the same state can be realized by discharging the ink from the ejection openings using a suction pump with the ejection opening forming surface of the recording head 20** sealed with a capping member.

Figure 5:
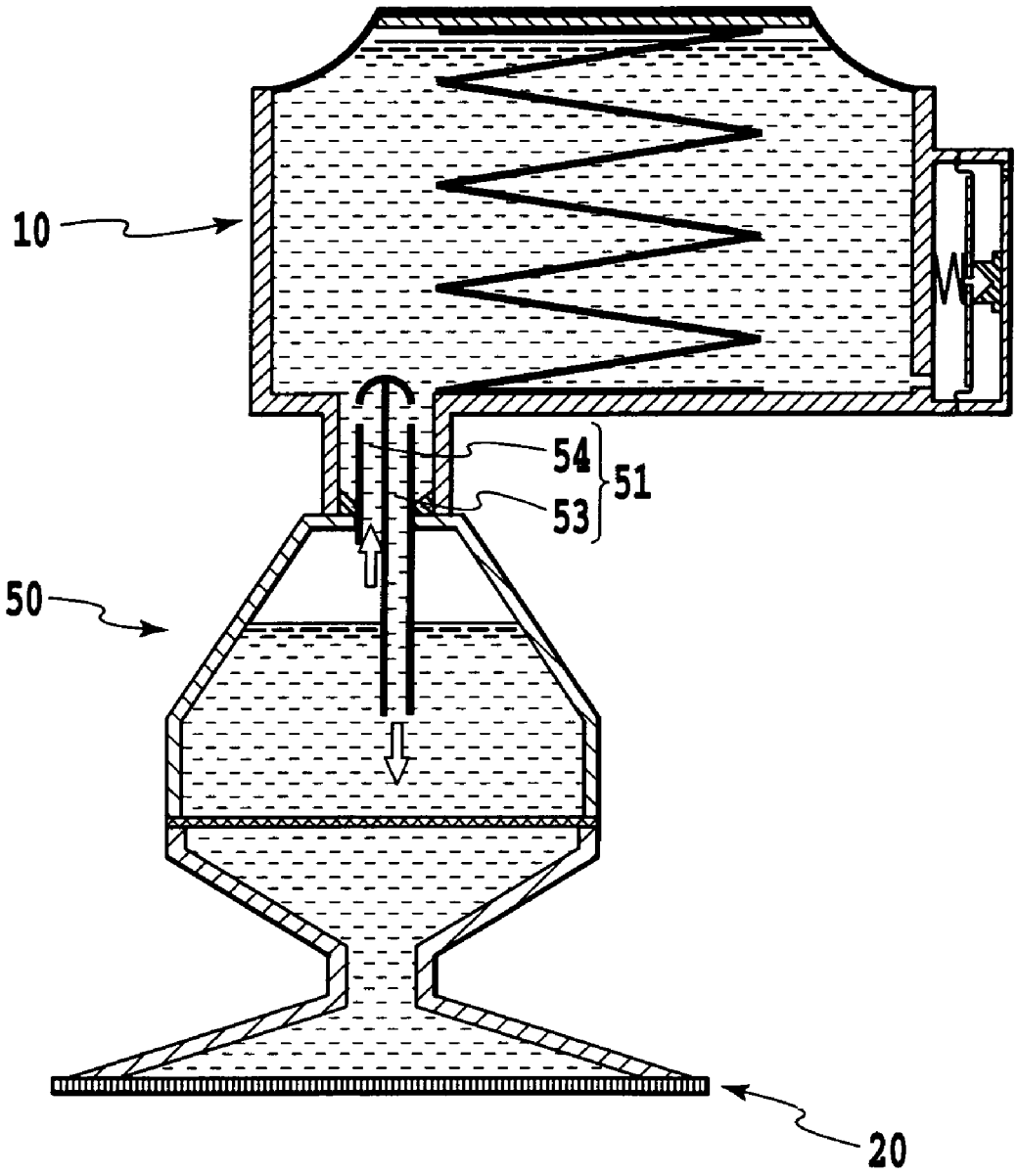
FIG. 5 is a schematic sectional view showing a state in which ink ejection or discharge of FIG. 4 is stopped, for explaining a gas removal process of the first embodiment.

FIG. 5 shows a state in which the ejection of the ink or the suction of the ink from the ejection opening forming surface has stopped. In this state, a water head difference generates a force that causes the ink in the ink flow channel 53 to move into the liquid chamber 50 and a force that discharges air in the air flow channel 54 into the ink tank 10. A theoretical description of this state will be given later.

Figure 6:
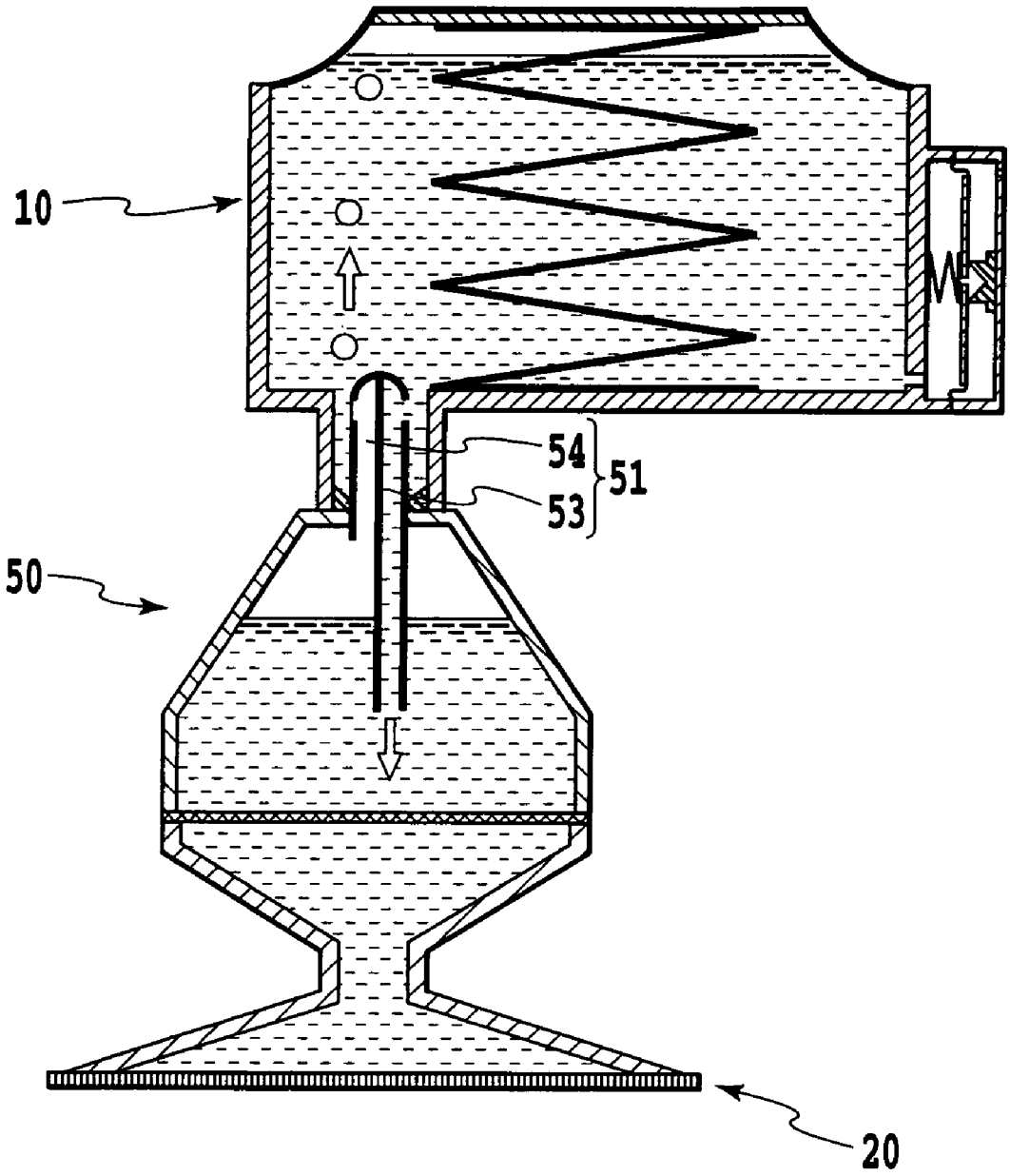
FIG. 6 is a schematic sectional view showing a state, following the state of FIG. 5, in which ink movement and gas discharge simultaneously proceed, for explaining a gas removal process of the first embodiment.

FIG. 6 shows a state in which the movement of the ink into the liquid chamber 50 and the discharge of air into the ink tank 10 simultaneously proceed because of those forces.

Figure 7:
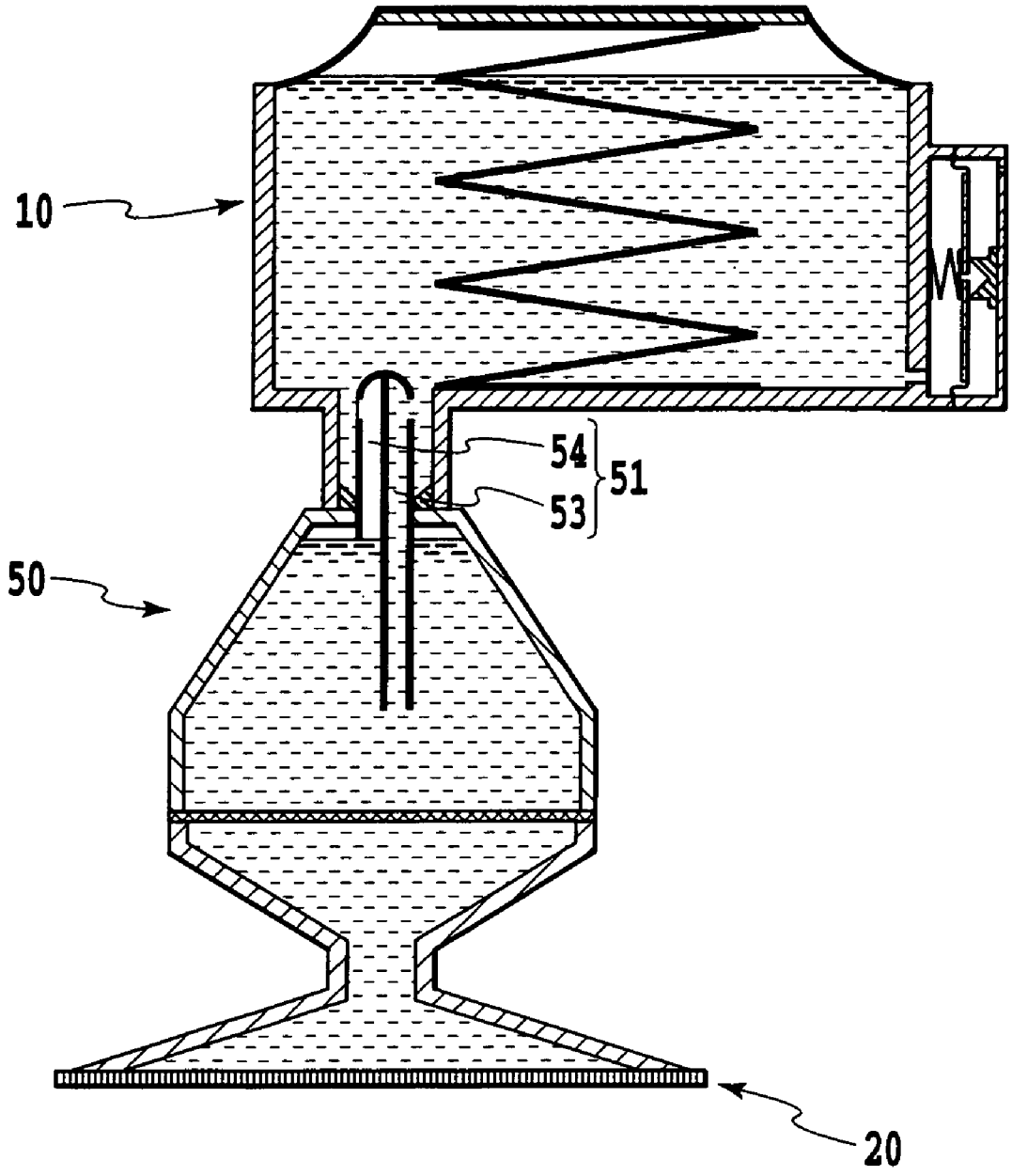
FIG. 7 is a schematic sectional view showing a state in which the ink ejection and the gas discharge are stopped, for explaining a gas removal process of the first embodiment.

FIG. 7 shows a state in which the gas-liquid interface in the region upstream of the filter has risen to the position of the head side opening 54*h* of the air flow channel 54, and the movement of the ink and the discharge of air stop.

Figure 8:
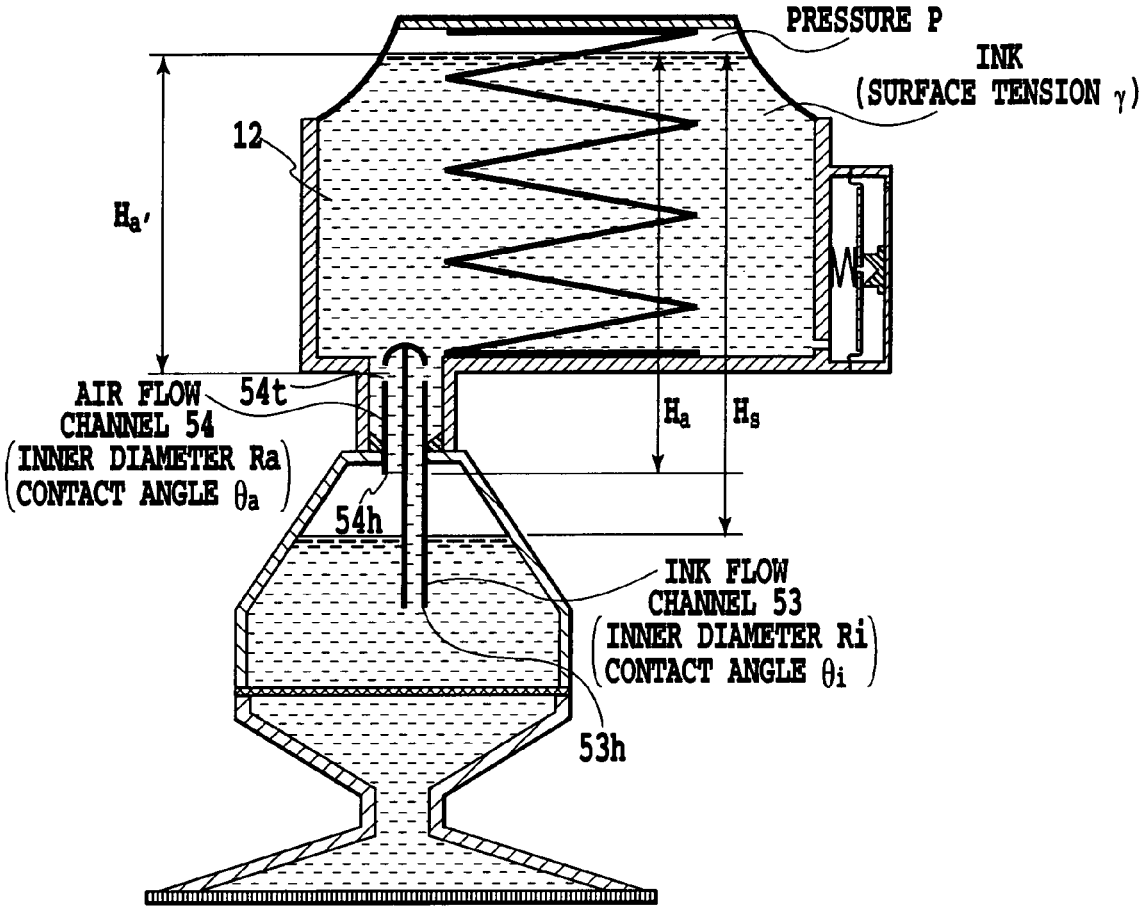
FIG. 8 is an explanatory view for explaining the principle of the ink movement and gas discharge of the first embodiment.

Balance between pressures of respective portions in the state shown in FIG. 5 will be described with reference to FIG. 8. While FIG. 5 shows a state in which the ink is moved and air is discharged, FIG. 8 is based on an assumption that the movement and the discharge have not occur yet for the purpose of description.

The pressure of the gas residing in the region upstream of the filter will now be discussed. Let us assume that the pressure of bubbles in the ink containing chamber 12 is represented by P and that the pressure originating from the water head difference between the ink interface in the ink containing chamber 12 and the ink interface in the region upstream of the filter is represented by Hs. Then, the pressure of the gas in the region upstream of the filter is greater than the pressure of the gas in the ink containing chamber 12 by the pressure Hs, i.e., it is represented by P+Hs. The pressure increase is attributable to the fact that the liquid chamber 50 or the recording head 20 is a closed structure and will not occur in a configuration in which there is an atmosphere communication hole between the ink tank and the recording head as seen in the related art as described above (e.g., Japanese Patent Application Laid-open No. 5-96744(1993)).

Let us now discuss the balance of pressures in the position of the meniscus at the head side opening 54*h* of the air flow channel 54. Since it is assumed that a pressure P+Ha acting downward is balanced against a pressure acting upward that is the above-described gas pressure P+Hs, the difference between the upward and downward pressures is balanced against a pressure Ma originating from meniscus that is expressed by the following expression.

$$Ma=2\gamma\cos\theta a/Ra \qquad \text{Equation 1}$$

Where γ represents the surface tension of the ink; θa represents the angle at which the ink contacts the air flow channel 54; and Ra represents the diameter (inner diameter) of the air flow channel 54.

Therefore, the balance of the pressures in the position of the head side opening 54*h* of the air flow channel 54 is expressed by the following expressions.

$$P+Hs-(P+Ha)=Ma \qquad \text{Equation 2}$$

$$Hs-Ha=Ma \qquad \text{Equation 3}$$

The expressions indicate a state in which the pressure originating from the water head difference between the position of the meniscus in the air flow channel 54 and the ink interface in the region upstream of the filter is balanced against the pressure originating from the meniscus in the air flow channel.

Let us assume that the volume of the residual gas in the region upstream of the filter increases to satisfy:

$$Hs-Ha>Ma \qquad \text{Equation 4}$$

Then, since the pressure of the gas in the region upstream of the filter is higher, the meniscus in the air flow channel 54 begin to move toward the ink containing chamber 12, which results in a movement of air toward the ink containing chamber 12. Accordingly, the ink in the ink containing chamber 12 moves into the liquid chamber 50 through the ink flow channel 53, and the ink level in the liquid chamber is also raised.

Since the volumetric capacity of the air flow channel is much smaller than that of the liquid chamber, the rise of the ink level in the liquid chamber 50 having a relatively large volumetric capacity is not so great at the initial stage of the movement of air. On the contrary, the position of meniscus in the air flow channel 54 quickly moves to the position of an ink tank side opening 54*t* of the channel. Therefore, a pressure (Hs−Ha) originating from a water head difference between the position of the ink tank side opening 54*t* of the air flow channel 54 and the position of the ink interface in the region upstream of the filter becomes considerably greater than the pressure originating from the meniscus on the air flow channel, which promotes the elimination of the air.

While the introduction of air into the ink tank is in progress, the position of the meniscus in the air flow channel 54 is the position of the tank side opening 54*t* of the air flow channel 54. Let us assume that Ha' represents a pressure originating from a water head difference in the position of the tank side opening. Then, the air moves as long as the following relationship is true.

$$Hs-Ha'>Ma' \qquad \text{Equation 5}$$

where Ma' represents the pressure of the meniscuses formed in the position of the tank side opening of the air flow channel. The movement of the air stops when the following relationship becomes true before the ink interface in the region upstream of the filter reaches the position of the head side opening 54*h* of the air flow channel.

$$Hs-Ha'<Ma' \qquad \text{Equation 6}$$

However, when the ink interface in the region upstream of the filter reaches the position of the head side opening 54*h* of the air flow channel with the relationship expressed by Equation 5 kept unchanged, the pressure of the meniscus formed at the head side opening 54*h* of the air flow channel will be also involved in the pressure balance. Thus, the movement of the air stops when the following relationship becomes true.

$$La<Ma+Ma' \qquad \text{Equation 7}$$

where La represents a pressure originating from a water head difference corresponding to the length of the air flow channel).

However, the movement of the air does not stop, and the ink interface further rises in the air flow channel when:

$$La>Ma+Ma' \qquad \text{Equation 8}$$

When the ink interface moves in the air flow channel, the air moves as long as the following relational expression is true.

$$Hs'-Ha'>Ma'+Ms' \qquad \text{Equation 9}$$

where Hs' represents a pressure originating from a water head difference between the ink interface in the air flow channel and the ink interface in the tank, and Ms' represents a dynamic meniscus pressure that is generated at the ink interface in the air flow channel. Since the ink contacts the flow channel at different angles in a dynamic state and a static state, the pressure Ma that is considered when the movement of the air begins and the dynamic pressure Ms' have different values for the same pipe diameter, and Ma is greater than Ms'.

Figure 9:
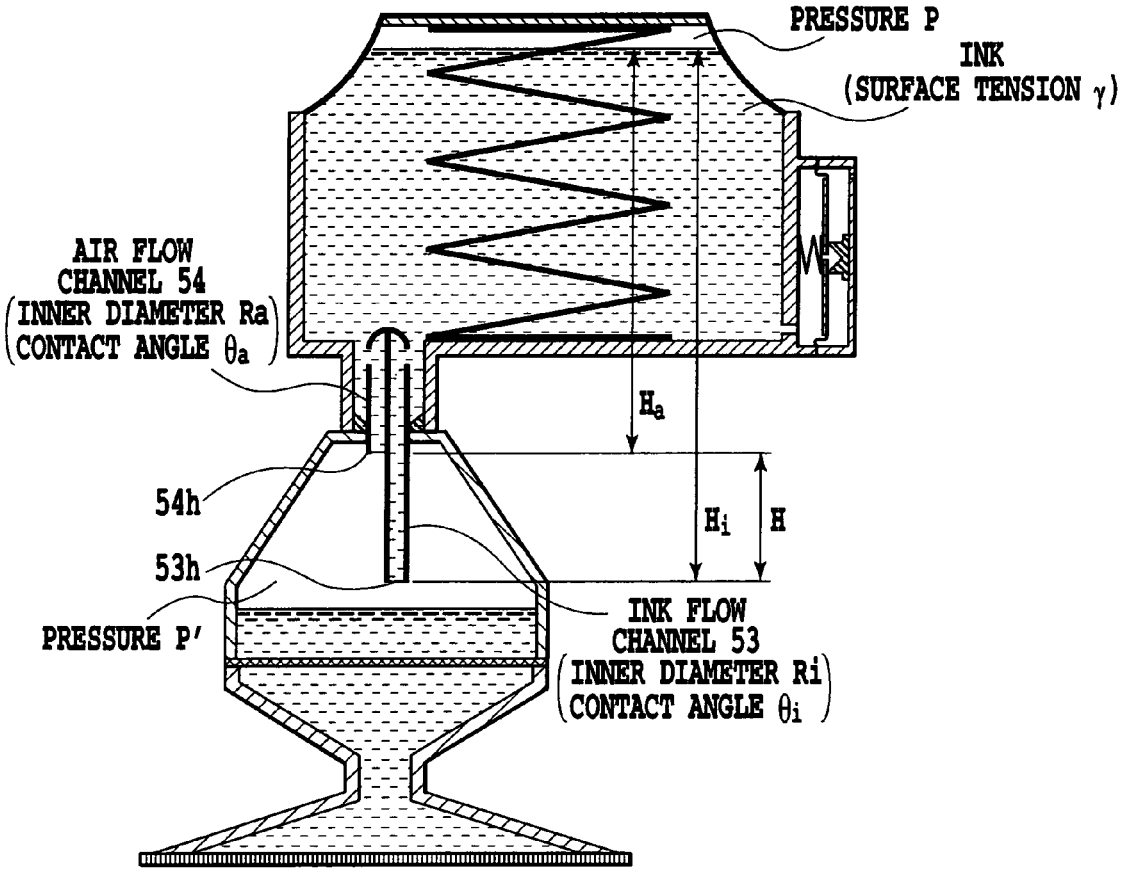
FIG. 9 is an explanatory view for explaining the principle of the ink movement and gas discharge of the first embodiment under different conditions from those of FIG. 8.

While the above discussion has addressed a case wherein the head side opening 53*h* of the ink flow channel 53 is in contact with the ink as shown in FIG. 2, a discussion will now be made on a state in which the head side opening 53*h* of the ink flow channel 53 is also not in contact with the ink in the liquid chamber 50 as shown in FIG. 9 as a result of further progress of ink consumption.

In FIGS. 2 to 7 and FIG. 8, since the head side opening of the ink flow channel 53 is in contact with the ink, consideration is needed only on the balance of pressures in the position of meniscus in the air flow channel. In the state shown in FIG. 9, however, consideration must be also paid on meniscus formed in the ink flow channel 53.

Let us assume that the state shown in FIG. 9 is kept unchanged. Then, the balance of pressures in the positions of meniscus in each of the air flow channel 54 and the ink flow channel 53 in this state is expressed by the following expressions where P' represents a pressure of a gas residing in the liquid chamber 50 and Mi represents a pressure originating from meniscus formed in the ink flow channel 53.

$$P'-(P+Ha)=Ma \text{ and } P'-(P+Hi)=Mi \qquad \text{Equations 10}$$

Thus, no exchange of the fluids occurs in the ink tank and liquid chamber. Therefore, the following expressions need to be true in order that the air is eliminated and the ink is moved.

$$P'-(P+Ha)>Ma \text{ and } P'-(P+Hi)<Mi$$

They can be changed to:

$$P'-P>Ha+Ma \text{ and } P'-P<Hi+Mi$$

Therefore:

$$Hi+Mi>Ha+Ma$$

$$Hi-Ha=H>Ma-Mi \qquad \text{Equation 11}$$

Thus, the movement of the ink and the elimination of the air are determined whether they take place or not depending on the relationship between a pressure difference H in terms of a water head corresponding to the difference in the vertical direction between the positions of the head side openings 53*h* and 54*h* of the ink flow channel 53 and the air flow channel 54, respectively, and a difference between the pressures originating from the meniscuses in the air flow channel 54 and the ink flow channel 54. Therefore, what is preferred is to adjust the negative pressure in the liquid chamber appropriately, for example, by ejecting the ink or sucking the ink from the ejection opening forming surface or the like.

While the air flow channel 54 and the ink flow channel 53 have been described above as independent communication channels that are completely separate from each other, those flow channels maybe in communication with each other through a microscopic communication channel in practice. The reason is that advantages expected from such an arrangement can be achieved without hindering the above-described operation of eliminating air provided that the force of meniscuses formed in the microscopic communication channel is at a level that has substantially no influence in comparison to the force of meniscuses formed at the flow channel openings, pressures originating from a water head difference between liquid levels, and a negative pressure in the ink tank as discussed above. This also applies to other embodiments of the invention to be described later.

As seen in the above-described embodiment, one of major features of the invention is that means for introducing air into a liquid supply system is disposed only in an ink tank. That is, since no air is directly introduced into the liquid chamber 50, the above-described air eliminating operation is substantially completed only at the time of the replacement of an ink tank, and there is substantially no need for considering the same operation during normal use of ink (during an ink ejecting operation of the recording head). On the contrary, according to Japanese Patent Application Laid-Open No. 2001-187459, since air is introduced into a liquid chamber (a main tank in this document) while ink is used, a strict consideration must be paid on requirements to be met to allow gas-liquid exchange also during use of ink.

Specifically, since a liquid level at which gas-liquid exchange can take place is lowered during use of ink as described above, there is a limit ink flow volume at which gas-liquid exchange stops because an ink flow channel length H is limited and a state as shown in FIG. 9 is eventually reached after increases in the flow volume (the amount of supplied ink), although gas-liquid exchange can take place as shown in FIG. 8 in a static state.

On the contrary, in the present embodiment, since air introducing means is provided at the ink tank 10, there is no reduction of the liquid level in the liquid chamber (no accumulation of air) caused of introduction of air when ink is used. Since it is therefore possible not only to design the liquid chamber with a small size but also to supply ink through the air flow channel in addition to the ink flow channel during use of ink, influence of pressure loss at the connecting section can be reduced, which makes it possible to use a thin connecting pipe as the connecting section. As a result, the ink supply system can be made compact as a whole.

Even in the present configuration, when ink consumption continues after the ink in an ink tank 10 is completely used up, the ink level may go down into the liquid chamber to cause the air introduction means (valve chamber 30) to introduce air into the liquid chamber 50 through the ink containing chamber 12. In this case, however, since the ink in the ink tank 10 and the connecting section 51 has already run out, no pressure loss occurs in those regions. Thus, no limit is put on the ink flow volume even when such a situation is taken into consideration.

In the present embodiment, the interior of the connecting section 51 is divided into two parts to provide two flow channels, and the flow channels are made different from each other in the elevation of the positions of their head side openings. This makes it possible to transport a gas residing in the region upstream of the filter to the ink tank quickly without a need for a complicated configuration.

Further, a gas residing in the liquid chamber can be quickly and smoothly transported to the ink tank to eliminate it from the supply channel by ejecting a small amount of ink or sucking ink from the side of the ejection opening forming surface after an ink tank replacing operation. Therefore, the ink will not be wasted in a large amount as experienced in eliminating a gas by performing the suction operation through the ejection openings.

When the negative pressure in the ink containing chamber is increased to a predetermined value or higher in the process of supplying ink from the ink tank, the valve chamber operates to take a gas from the outside into the ink containing chamber as described above.

In the case that an ink including a pigment as a coloring material is used, sedimentation of pigment particles can be distributed when air is transported to the tank to maintain the preservation stability of the ink and the reliability of ejection.

Second Embodiment

A liquid supply system according to a second embodiment of the invention will now be described with reference to FIGS. 10 and 11. Parts that can be similarly configured between the present and the first embodiments are indicated by like reference numerals in respective positions.

Figure 10:
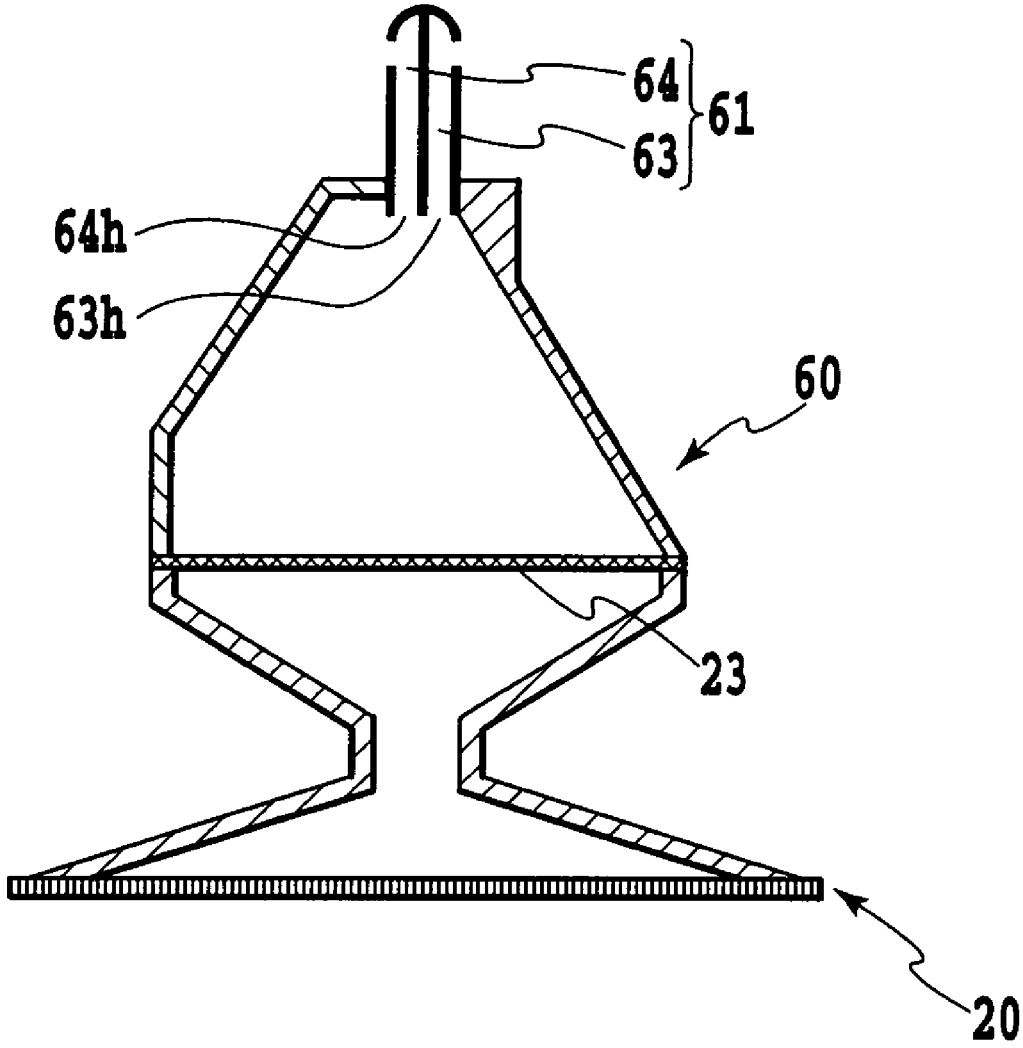
FIG. 10 is a schematic sectional view of a liquid chamber that is applied to a liquid supply system according to a second embodiment of the invention.

FIG. 10 is a schematic sectional view of a liquid chamber 60 that is integral with a recording head 20. As illustrated, the interior of a connecting section 61 of the present embodiment is divided into two parts to provide two flow channels just as in the first embodiment except that there is substantially no difference in elevation between the position of a head side opening 63*h* of an ink flow channel 63 and the position of a head side opening 64*h* of an air flow channel 64. However, while the head side opening 64*h* of the air flow channel 64 fully opens into the space in the liquid chamber 60, a part of the head side opening 63*h* of the ink flow channel 63 is contiguous with an inner wall of the liquid chamber 60.

Figure 11:
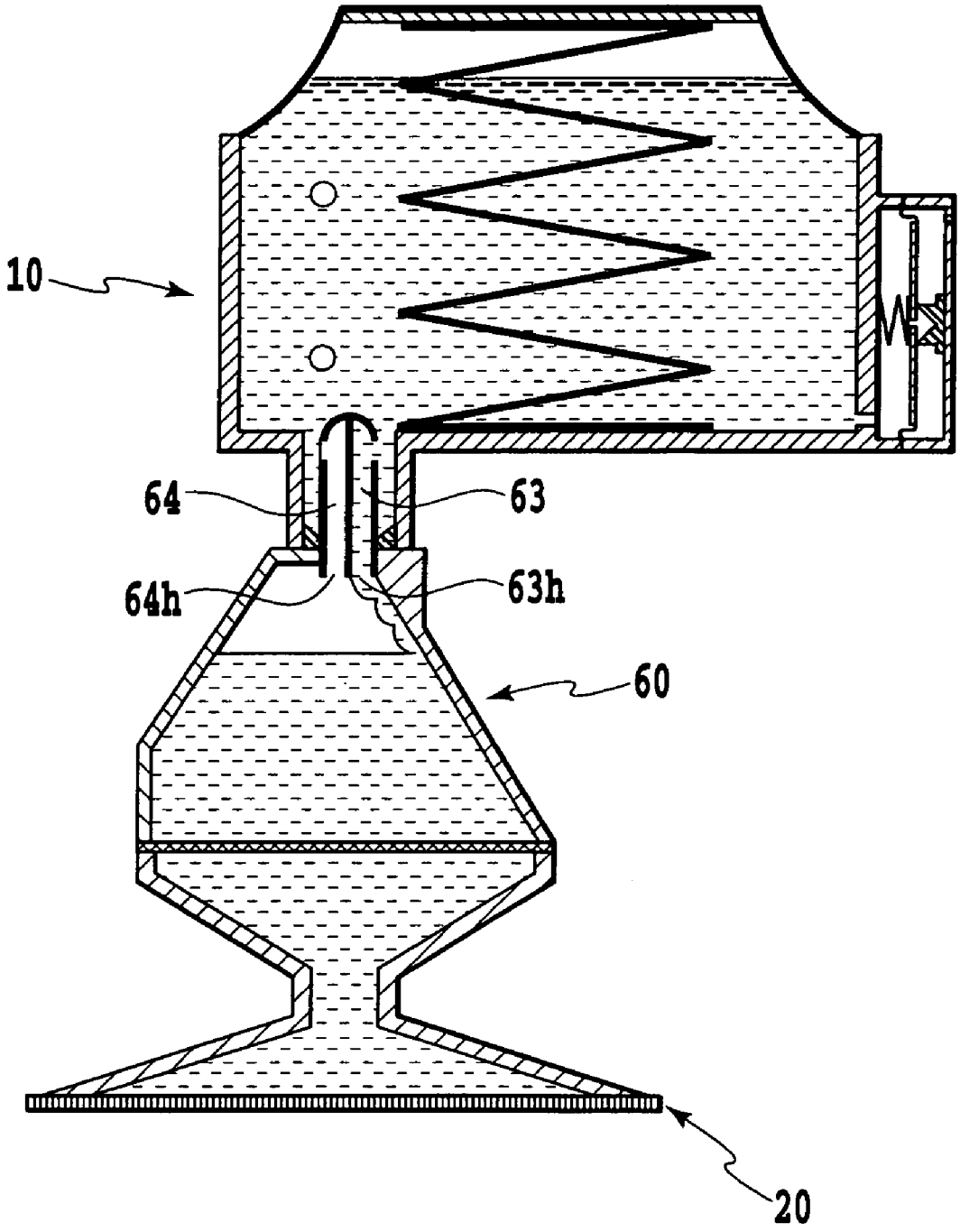
FIG. 11 is a schematic sectional view for explaining a configuration and an operation of the liquid supply system according to the second embodiment of the invention.

FIG. 11 shows an ink tank 10 attached to such a liquid chamber, and a phenomenon that occurs in such a case will be described below.

When ink meniscus exist in the ink flow channel 63 to keep the balance of pressures in the attached state, air is not eliminated as apparent from the above description with reference to Equations 10. However, when the negative pressure in the liquid chamber increases as a result of ejection of ink or suction of ink from the side of the ejection opening forming surface to lower the position of the meniscus in the ink flow channel 63 to the position of the head side opening 63*h*, a capillary force causes the ink to flow down along the inner wall of the liquid chamber because a part of the opening 63*h* is contiguous with the inner wall, which disallows meniscus to be formed at the opening 63*h*. Then, the pressure of the gas in the region upstream of the filter increases because of the volume of the ink that has moved into the head flow channel, and meniscus in the air flow channel 64 is broken to allow air to be discharged into the ink tank 10.

In the configuration of the present embodiment, the movement of the ink and the discharge of air take place even when there is no difference between the positions of the elevations of the head side openings of the ink flow channel and the air flow channel, which consequently makes it possible to reduce the length of the connecting section 61. Thus, the liquid chamber of the recording head integral with the same can be made further compact compared to the first embodiment.

It is desirable to choose an appropriate configuration, material, surface condition of the inner wall or the like in accordance with the physical properties of the ink to be used.

Third Embodiment

Figure 12:
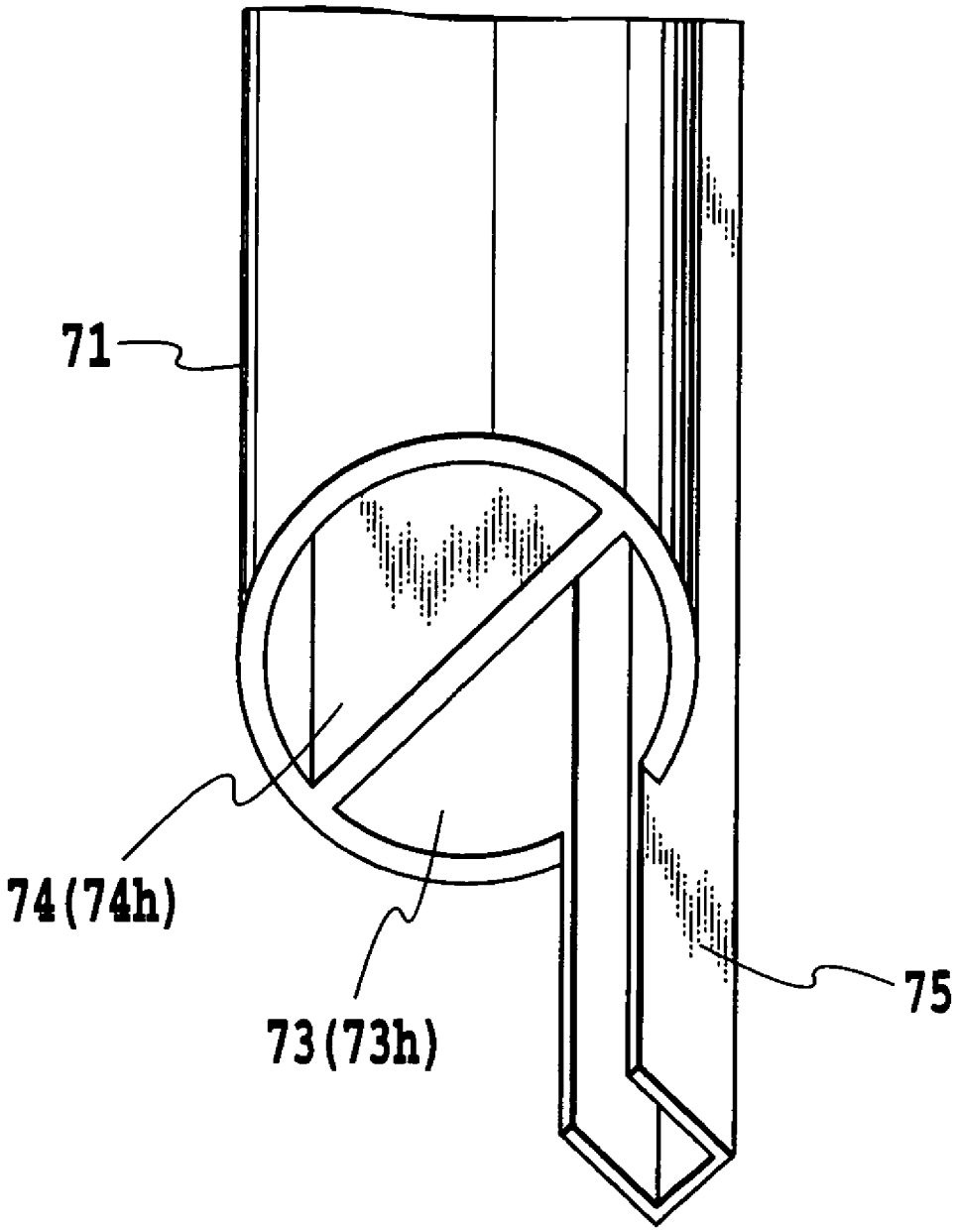
FIG. 12 is a perspective view showing a main portion of a connecting section that is applied to an ink supply system applied to a third embodiment of the invention.

FIG. 12 is a detailed view of a head side opening of a connecting section used in a third embodiment of the invention which employs a configuration of a liquid chamber that is generally similar to the configuration in the second embodiment. Specifically, while the interior of a connecting section 71 of the present embodiment is also divided into two parts to provide two flow channels, there is substantially no difference in elevation between the position of a head side opening 73*h* of an ink flow channel 73 and the position of a head side opening 74*h* of an air flow channel 74. However, a portion 75 formed with fine grooves is provided along the ink flow channel, and the portion 75 extends from the head side opening 73*h* into the liquid chamber.

In this configuration, ink enters the fine grooves because of a capillary force of the ink, which prevents formation of meniscus that exert a high pressure at the head side opening of the ink flow channel 73. This facilitates a flow of ink from the ink flow channel. That is, the present embodiment is advantageous similarly to the second embodiment in that the movement of ink and the elimination of air take place even when there is no difference in elevation between the positions of head side openings of the ink flow channel and the air flow channel.

The configuration for preventing formation of meniscus that exert a high pressure at the head side opening of the ink flow channel is not limited by the second and third embodiments. For example, the same effect can be expected by enlarging the end section of the head side opening, providing the flow channels with different diameters, or providing the flow channels with inner surfaces in different conditions (e.g., angles of contact with ink) through appropriate selection of materials and surface treatments, for example.

Fourth Embodiment

Figure 13A:
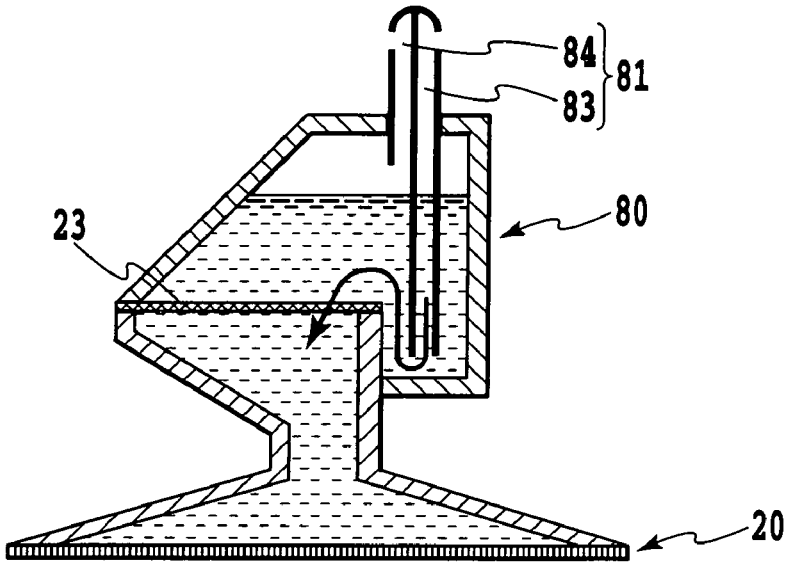
FIGS. 13A and 13B are schematic sectional views for explaining a configuration and an operation of a liquid supply system according to a fourth embodiment of the invention.
Figure 13B:
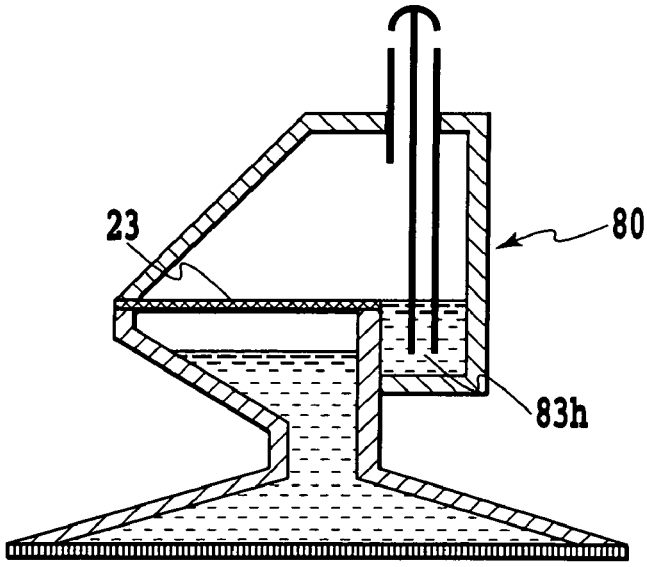

FIGS. 13A and 13B are views for explaining a configuration and an operation of a liquid chamber according to a fourth embodiment of the invention.

The interior of a connecting section of a liquid chamber 80 of the present embodiment is also divided into two parts to provide an ink flow channel 83 and an air flow channel 84 just as in the first embodiment, but a configuration is employed in which a position of a head side opening of the ink flow channel 83 is located below the plane of a filter.

Therefore, when a sufficient amount of ink exists in the region upstream of the filter, the ink flows as indicated by the arrow in FIG. 13A to be supplied to a recording head 20.

FIG. 13B shows a state in which ink consumption proceeded after the ink tank (not shown) is exhausted. As apparent from the figure, since a head side opening 83*h* of the ink flow channel 83 is located below the plane of the filter 23 in the vertical direction, the ink in the vicinity of the head side opening 83*h* remains unused, and the head side opening 83*h* of the ink flow channel 83 is therefore always in contact with the ink.

In such a configuration, therefore, air is always eliminated as long as the relationship represented by Equation 4 is satisfied, and there is no need for controlling the negative pressure in the liquid chamber in consideration to the relationship represented by Equation 11. It is also possible to reduce an ink flow channel length required for always keeping the head side opening of the ink flow channel in contact with the ink for the purpose of preventing formation of meniscus.

Fifth Embodiment

Figure 14A:
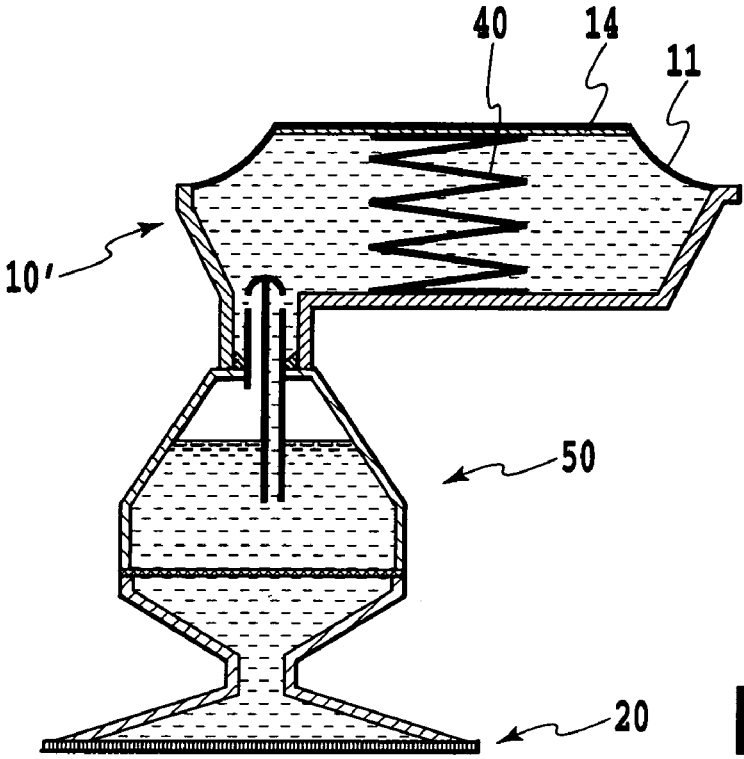
FIGS. 14A and 14B are schematic sectional views for explaining a configuration and an operation of a liquid supply system according to a fifth embodiment of the invention.
Figure 14B:
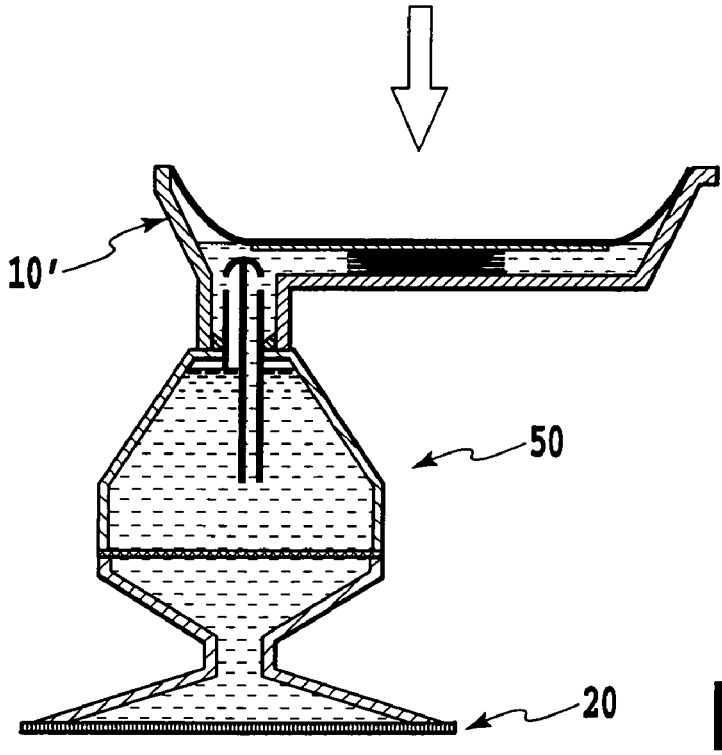

FIGS. 14A and 14B are views for explaining a configuration and an operation of an ink supply system according to a fifth embodiment of the invention.

While the above-described embodiments have a configuration in which a valve chamber for introducing air is disposed in an ink tank to introduce air into the ink tank from the valve chamber as ink is supplied, an ink tank 10' in the present embodiment is not provided with a valve chamber for introducing air from the outside and is substantially comprised of only an ink containing chamber, as shown in FIG. 14A. A liquid chamber 50 and a recording head 20 have configurations similar to those in the first embodiment.

In such a configuration, a more adequate negative pressure is applied to a sheet member 11, a spring member 40, and a pressure plate 14, and the sheet member 11 is displaced downward as it is as ink consumption proceeds as shown in FIG. 14B unless the requirement represented by Equation 4 is satisfied. When the requirement represented by the same expression is satisfied, it is obvious that air in a region upstream of a filter is transported into the ink tank 10' as in the above embodiments to be eliminated from the ink supply channel.

Sixth Embodiment

Figure 15A:
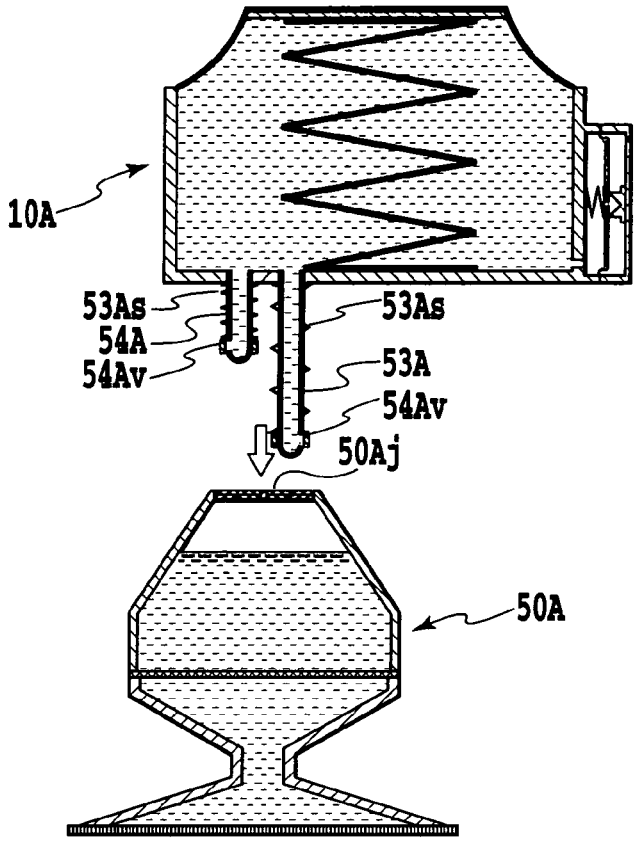
FIGS. 15A and 15B are schematic sectional views for explaining a configuration and an operation of a liquid supply system according to a sixth embodiment of the invention.
Figure 15B:
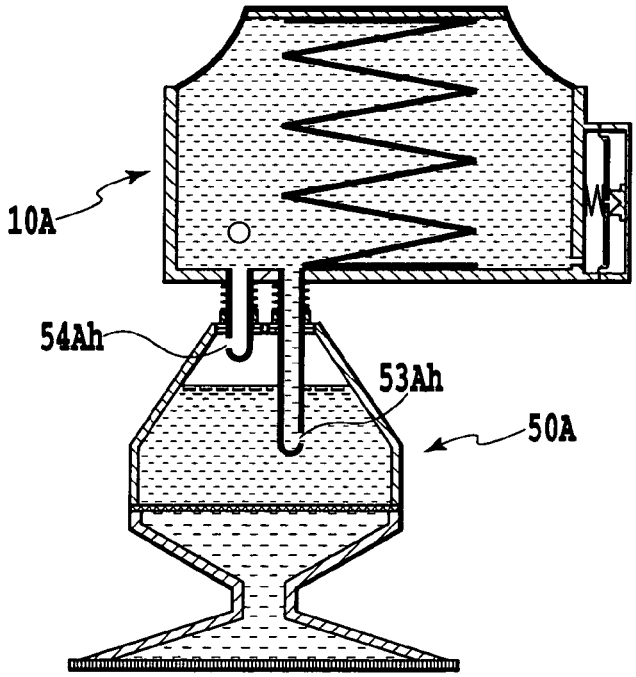

FIG. 15A and 15B are views for explaining a configuration and an operation of an ink supply system according to a sixth embodiment of the invention.

In the above-described embodiments, a connecting section having an ink flow channel and an air flow channel is provided at a recording head or a liquid chamber. The present embodiment employs a configuration in which an ink flow channel member 53A and an air flow channel member 54A are provided at an ink tank 10A configured substantially similarly to that in the first embodiment as shown in FIG. 15A and in which the members are stuck into a liquid chamber 50 as shown in FIG. 15B when mounted.

Head side openings 53Ah and 54Ah of the ink flow channel member 53A and the air flow channel member 54A, respectively, are closed by valves 53Av and 54Av that are urged by springs 53As and 54As when the ink tank 10A is not mounted. In the configuration, as the ink flow channel member 53A and the air flow channel member 54A are stuck into the liquid chamber 50A through a mounting section 50Aj, the valves 53Av and 54Av are engaged with the mounting section 50Aj and displaced relatively while compressing the springs 53As and 54As, thereby opening the head side openings 53Ah and 54Ah.

In such a configuration, by mounting the ink tank 10A, operations similar to those in the first embodiment indicated by the states in FIG. 5 and later are performed to achieve a similar advantage. Specifically, in the present embodiment, the ink flow channel member 53A and the air flow channel member 54A are filled with ink, and pressures have already been generated in the positions of the openings of the respective members before the ink tank 10A is mounted, the pressures originating from a water head difference that depends on the lengths of the respective members. Therefore, when the ink tank 10A is mounted, discharge of air from the liquid chamber 50A through the air flow channel member 54A is started. In the first embodiment, the mounting of the ink tank 10 results in the state shown in FIG. 3 in which there is no difference between the vertical positions of meniscuses formed in the ink flow channel 53 and the air flow channel 54, which may necessitate an ink sucking operation or ink ejecting operation as shown in FIG. 4. On the contrary, the present embodiment is preferable in that such operations are not necessary because requirements for starting discharge of air have already been met at the time of mounting.

While the ink flow channel member 53A and the air flow channel member 54A are separate members in the illustrated embodiment, a connecting section whose interior is divided into two parts to form two flow channels may be used as in the above embodiments.

Seventh Embodiment

Figure 16A:
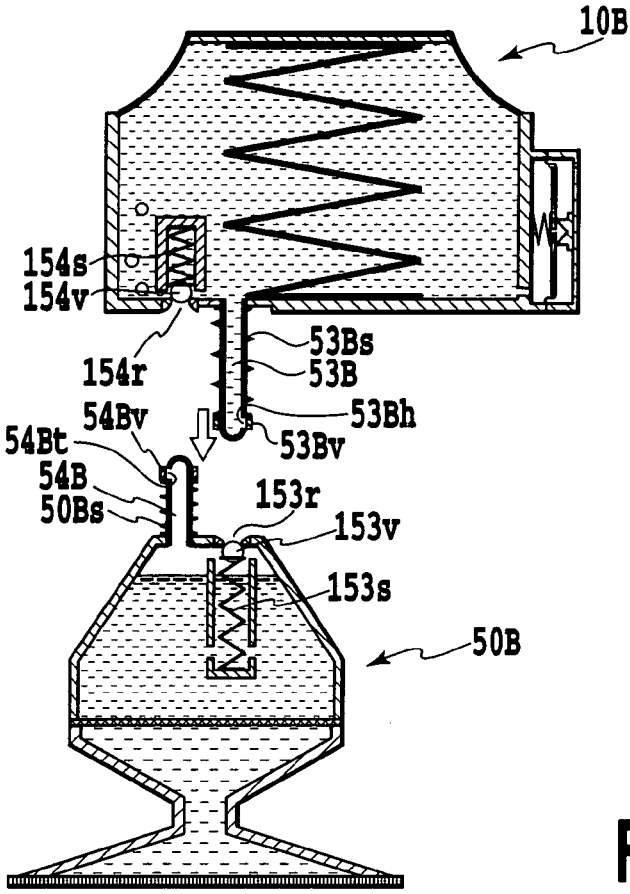
FIGS. 16A and 16B are schematic sectional views for explaining a configuration and an operation of a liquid supply system according to a seventh embodiment of the invention.
Figure 16B:
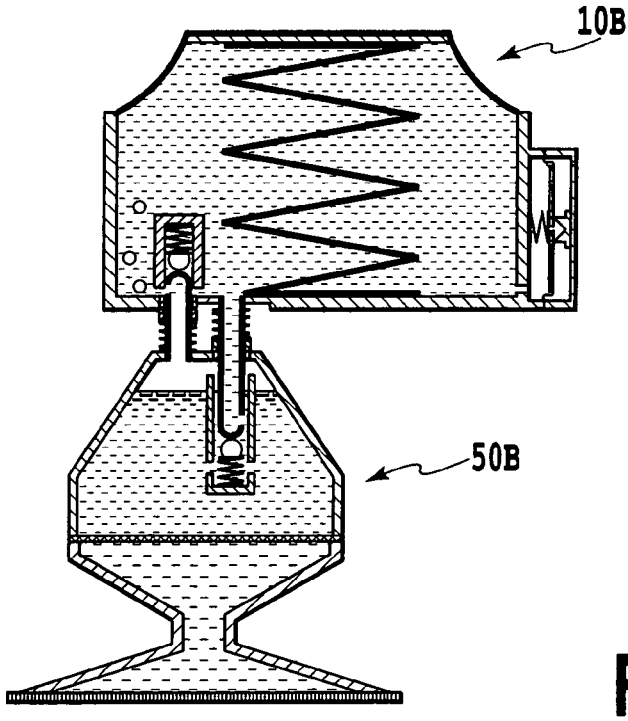

FIGS. 16A and 16B are views for explaining a configuration and an operation of an ink supply system according to a seventh embodiment of the invention.

While the sixth embodiment has addressed a case in which an ink flow channel and an air flow channel are provided at an ink tank, in the present embodiment, an ink flow channel member 53B is provided at an ink tank 10B substantially similar to that in the first embodiment in configuration, and an air flow channel member 54B is provided at a recording head or a liquid chamber 50B, as shown in FIG. 16A. Specifically, a configuration is employed in which, when the ink tank is mounted, the ink flow channel member 53B is stuck into the liquid chamber 50B and the air flow channel member 54B is stuck into the ink tank 10B as shown in FIG. 16B.

A head side opening 53Bh of the ink flow channel member 53B and a tank side opening 54Bt of the air flow channel member 54B are closed by valves 53Bv and 54Bv that are urged by springs 53Bs and 54Bs, respectively, when the ink tank 10B is not mounted. As the ink flow channel member 53B and the air flow channel member 54B are stuck into the liquid chamber 50B and the ink tank 10B, respectively, the valves 53Bv and 54Bv are relatively displaced while compressing the springs 53Bs and 54Bs, thereby opening the head side openings 53Bh and 54Bh. A valve 154*v* urged by a spring 154*s* is provided at an opening 154*r* of the ink tank 10B into which the air flow channel member 54*b* is stuck. A configuration is thereby provided in which the opening 154*r* is closed to prevent leakage of ink when the ink tank 10B is not mounted and in which the valve retracts while compressing the spring 154*s* to allow the air flow channel member 54B to be stuck as a mounting operation proceeds. Similarly, a valve 153*v* urged by a spring 153*s* is provided at an opening 153*r* of the liquid chamber 50B into which the ink flow channel member 53B is stuck. A configuration is thereby provided in which the opening 153*r* is closed when the ink tank 10B is not mounted and in which the valve retracts while compressing the spring 153*s* to allow the ink flow channel member 53B to be stuck as a mounting operation proceeds.

In this configuration, the ink flow channel 53B is filled with ink and the air flow channel 54B contains air in the state shown in FIG. 16A before the mounting of the ink tank 10B. Air is discharged when the ink tank 10B is mounted also in this state just as in the sixth embodiment, and there is no need for the ink sucking operation and ink ejecting operation for discharging the air. Further, the present configuration is preferable in that air can be easily discharged even when the length of each flow channel member is small because it is easy to provide a great difference between the elevations of the opening 53Bh of the ink flow channel member 53B and the opening 54Bt of the air flow channel member 54Bt.

Eighth Embodiment

Figure 17:
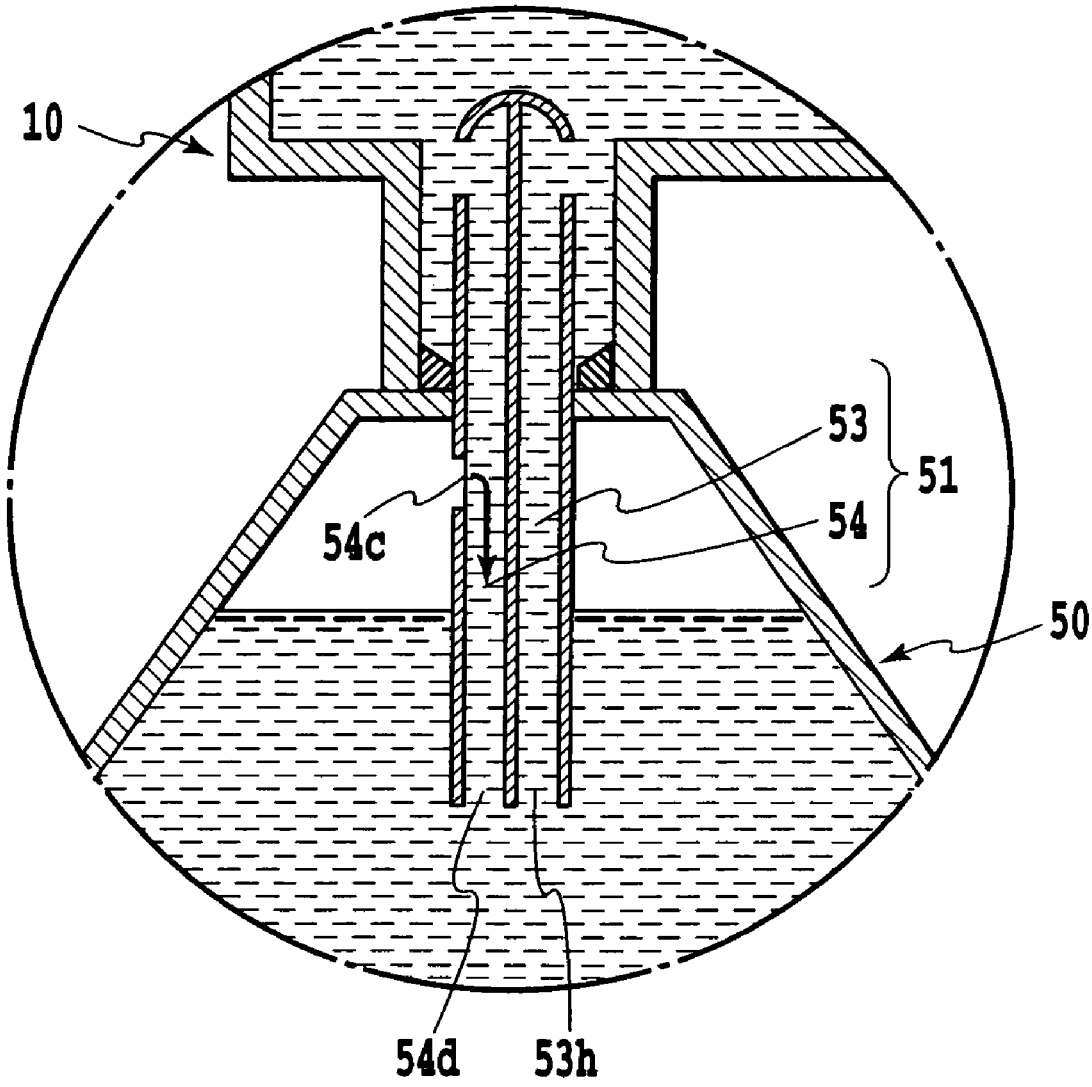
FIG. 17 is an enlarged view of the connecting section for explaining an eighth embodiment of the invention.

FIG. 17 is an enlarged view of a connecting section for explaining an eighth embodiment of the invention.

A connecting section 51 of the present embodiment is provided with two flow channels by dividing the interior of the same into two parts as in the first embodiment. In the present embodiment, however, an air flow channel 54 has two head side openings, i.e., a first opening 54*c* provided on a side of the flow channel and a second opening 54*d* that is substantially equal in elevation to a head side opening 53*h* of an ink flow channel. This results in two differences in operation from the first embodiment. First, this facilitates an ink ejecting operation for charging the air flow channel with ink. Since the second opening 54*d* is in substantially the same position as the head side opening 53*h* of the ink flow channel and is in contact with ink, the ink is prevented from dropping as seen in the state in FIG. 4 in the first embodiment. The point is therefore the fact that the charging of the air flow channel with ink is completed with the negative pressure in the liquid chamber 50 kept lower than that in the state in FIG. 4. The other point is that meniscus at the first opening 54*c* is easier to move than those in the first embodiment when the ink charging is completed. When meniscus is formed at the first opening 54*c*, the mobility of the meniscus is determined by the balance between a pressure originating from the meniscus and a pressure originating from a water head difference between the first opening 54*c* and the position of the liquid level in the liquid chamber 50. In the present embodiment, since gravity on the ink residing between the first opening 54*c* and the second opening 54*d* of the air flow channel 54 is added as a force acting on the meniscus rightward in the figure, the meniscus is in a state in which it is easy to move to the right.

Further, when the air flow channel 54 and the ink flow channel 53 are formed in the same member as in the present configuration, there is another advantage in that manufacturing accuracy of the connecting section can be maintained because the length of those channels can be made equal to each other.

(Specific Configuration Example of Ink Supply System)

Figure 18A:
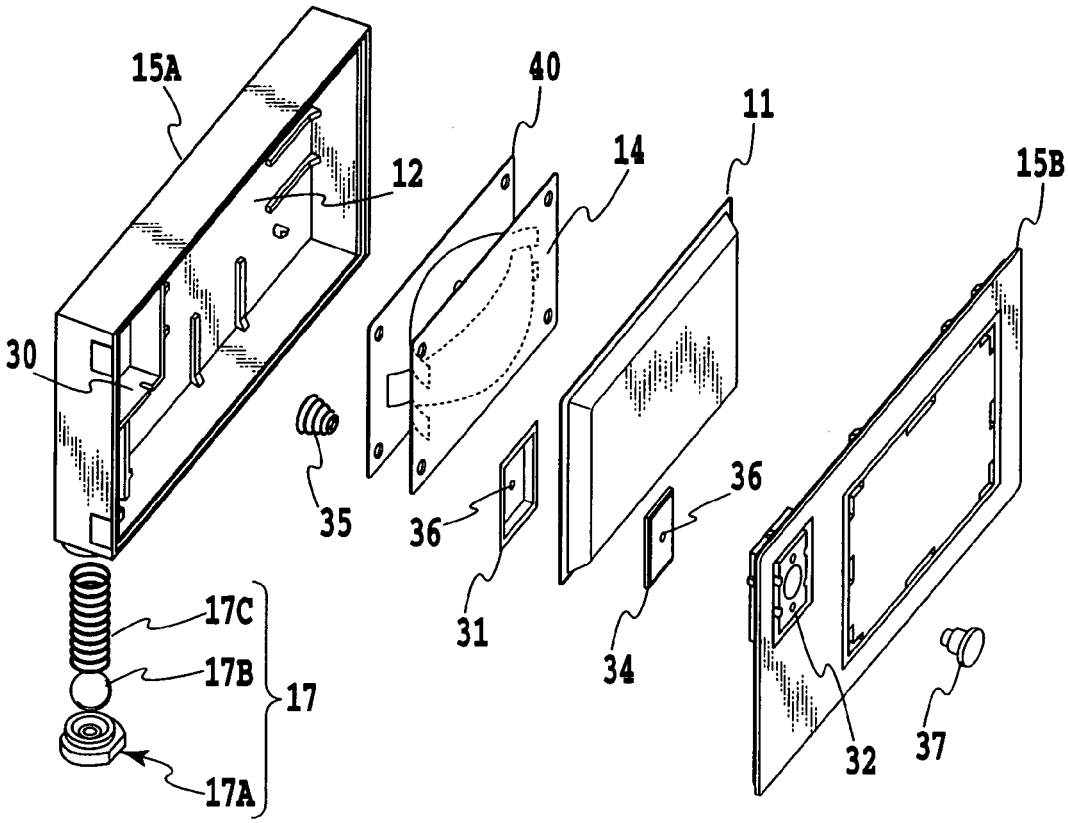
FIG. 18A is an exploded perspective view showing a specific configuration example of an ink tank to which the first embodiment of the invention is applied.
Figure 18B:
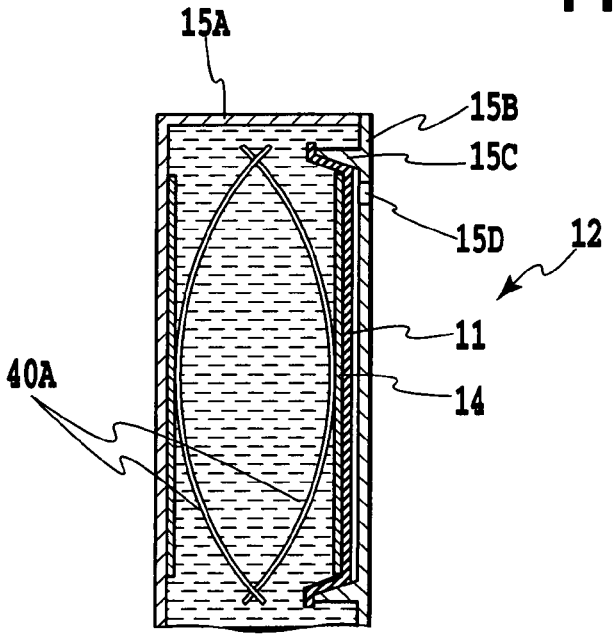
FIG. 18B is a transverse sectional view of an ink containing chamber portion of the ink tank.

FIG. 18A is an exploded perspective view showing a specific configuration example of an ink tank to which the first embodiment is applied. FIG. 18B is a transverse sectional view of an ink containing chamber portion.

Reference numerals 15A and 15B denote a casing member and a lid member, respectively, which form the outer casing 15 of the ink tank 10. The inside of the outer casing 15 is generally divided into three chambers: the ink containing chamber 12, a valve chamber 30, and a receiving chamber 65 of the connecting section 51.

The spring 40 disposed in the ink containing chamber 12 is formed, in the illustrated example, by combining a pair of leaf spring members 40A, each having a substantially U-shape in section, with their U-shaped open ends opposed to each other. A mode of this combination can be configured such that each leaf spring member 40A is made to have a concave and a convex portion formed at both ends and the concave portion of one leaf spring member 40A is thus mated with the convex portion of the other.

Furthermore, the pressure plates 14 are deposited, parallel to each other, on the back face portions of the individual leaf spring members. The back face of one leaf spring member is bonded to the inner plane portion of the convex portion of the sheet member 11. The sheet member 11 has the periphery portion adhered on a rib 15C provided on the lid member 15B. A space between the sheet member 11 and the lid member 15B is opened to atmosphere via an atmosphere communication hole 15D. This allows the sheet member 11 to be displaced or deformed as ink is consumed.

The spring 35, sheet member 31, and pressure plate 34 are housed in the valve chamber 30. Furthermore, the seal member 37 is attached to the lid member 15B such that the communication hole 36 can be opened and closed.

The sealing member 17 is housed in the receiving chamber 65 for the connecting section 51. In this example, the sealing member 17 includes a member 17A that forms an opening, into which the connecting section 51 sticks, at least of which periphery of the opening is made of elastic material such as rubber, a ball-like valve body 17B that can close the opening, and a spring 17C that urges the valve body 17B toward its closing position. Since an inside of ink tank 10 is under a negative pressure by a force of spring 40 even before being mounted, it is desirable to set the force of spring 17C in an appropriate condition to have valve body 17B seal the opening of the member 17 properly so as to avoid an ink leakage from the opening before being mounted.

Figure 19A:
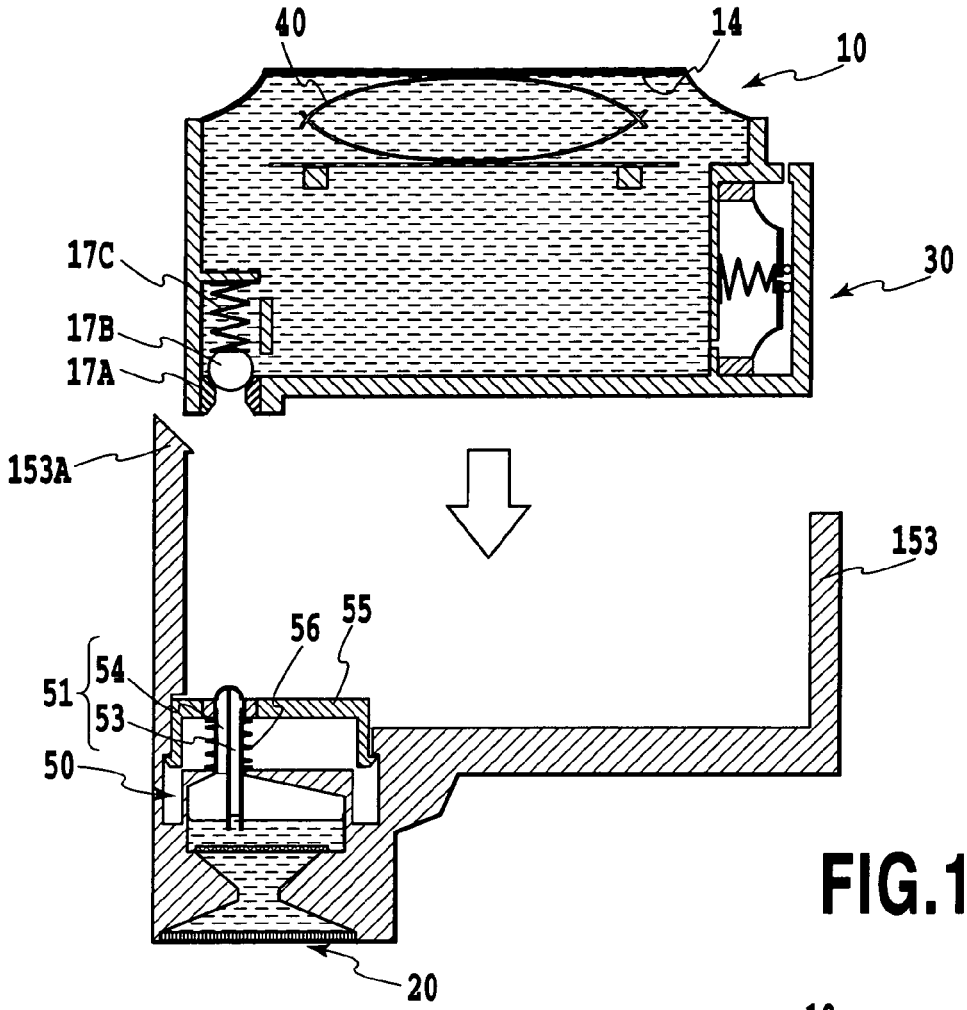
FIGS. 19A and 19B are sectional views showing a specific configuration example of an ink supply system to which the configuration of the first embodiment of the invention is applied.
Figure 19B:
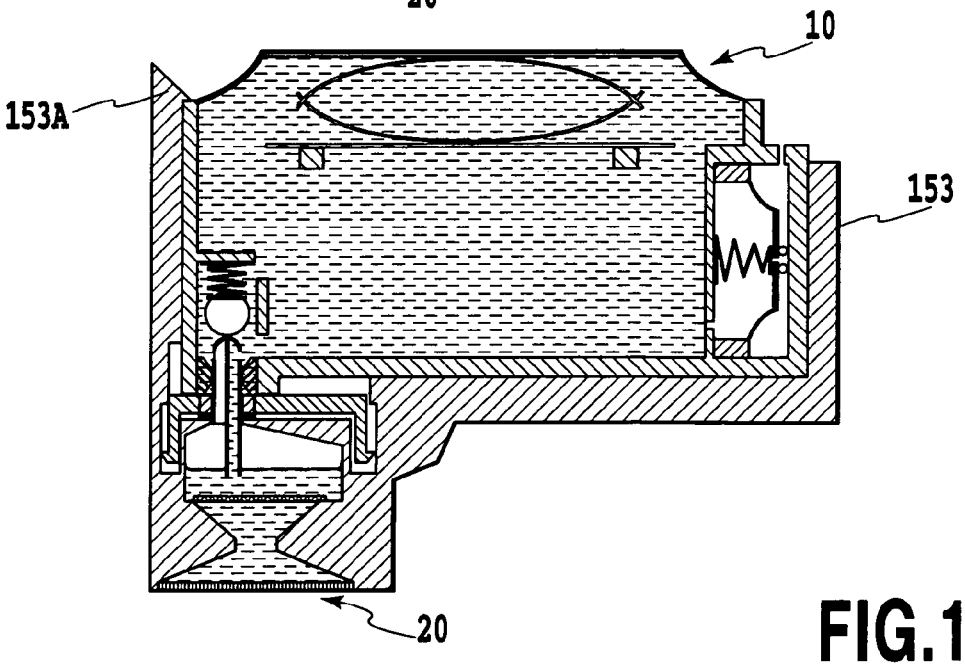

FIGS. 19A and 19B mainly show a specific configuration example of the ink supply system to which the configuration of the first embodiment shown in FIG. 1 is applied. Here, the ink tank 10, adopting the basic configuration shown in FIGS. 18A and 18B, is schematically shown in FIGS. 19A and 19B.

The ink tank 10 is attachable to and detachable from a carriage 153 holding the recording head 20 or the liquid chamber 50. When the ink tank 10 is attached to the carriage from thereabove in the arrowed direction as shown in FIG. 19A, a part of the tank outer casing 15 engages a latch portion 153A, thus holding the attached state as shown in FIG. 19B.

Reference numeral 55 denotes a closing member, up and down movably provided in the carriage 153, which is urged upward by a spring 56 to close the tank side openings of the ink flow channel 53 and air flow channel 54 during the non-attachment of the tank. This closing member 55 is moved down as the attachment of the ink tank 10 is carried out, thereby allowing the connecting section 51 to stick into the receiving portion 65 while opening the tank side opening of the connecting section 51.

In this example, the inner diameters of the air flow channel 54 and ink flow channel are both set to 0.8 mm, the length of the air flow channel (the length from the tank side opening to the head side opening) is set to 12 mm, and the length of the ink flow channel is set to 28 mm. Besides, the air and ink flow channels are both formed of the same stainless steel member. In this state, the present inventors have confirmed that air is reliably discharged when the height of the head side opening portion of the air flow channel from the liquid level is 5 mm or more. Specifically, when air is accumulated in the liquid chamber 50 and reaches 8 mm or more the height of the head side opening portion of the air flow channel from the liquid level reaches 8 mm or more, air is discharged through the next tank replacement. Accordingly, even when the ink flow channel is shortened to about 20 mm, it will not affect the air discharge.

Furthermore, in the state where the ink height of the liquid level in the liquid chamber 50 from the face of the filter 23 is 5 mm, the following have been confirmed: even when ink is supplied with the ink flow rate or volume set to 8 g/min, air will not be entrained or drawn into the downstream side of the filter, so that satisfactory recording is performed. Accordingly, when air is accumulated in the liquid chamber 50, air is reliably discharged to the ink tank 10 side. Furthermore, it becomes possible that a high flow rate is obtained to perform high-speed recording, and it is possible to provide a very compact ink supply system as a whole.

Besides, in any embodiment, the number of flow channels is not limited to two, but the connecting section may be provided with three flow channels or more. Besides, even when providing a connecting section whose inside is divided into a plurality of portions to form a plurality of flow channels, a partition wall between the flow channels is not only linearly formed as in the aforesaid example but also concentrically formed, thereby enabling providing a connecting section of multiple tube configuration.

Furthermore, when providing the connecting section whose inside is divided into a plurality of portions to form a plurality of flow channels, unless the transfer of gas and the movement of ink interfere with each other to hinder smooth and rapid gas-liquid exchange, the individual flow channels may not be completely separated from each other.

Besides, in the aforesaid, the valve chamber 30 for introducing ambient air into the ink tank 10 is made integral with the ink tank 10. However, if ambient air can be introduced directly into the ink tank 10 without via the liquid chamber 50, the valve chamber may not necessarily be formed integral with the ink tank.

Figure 20A:
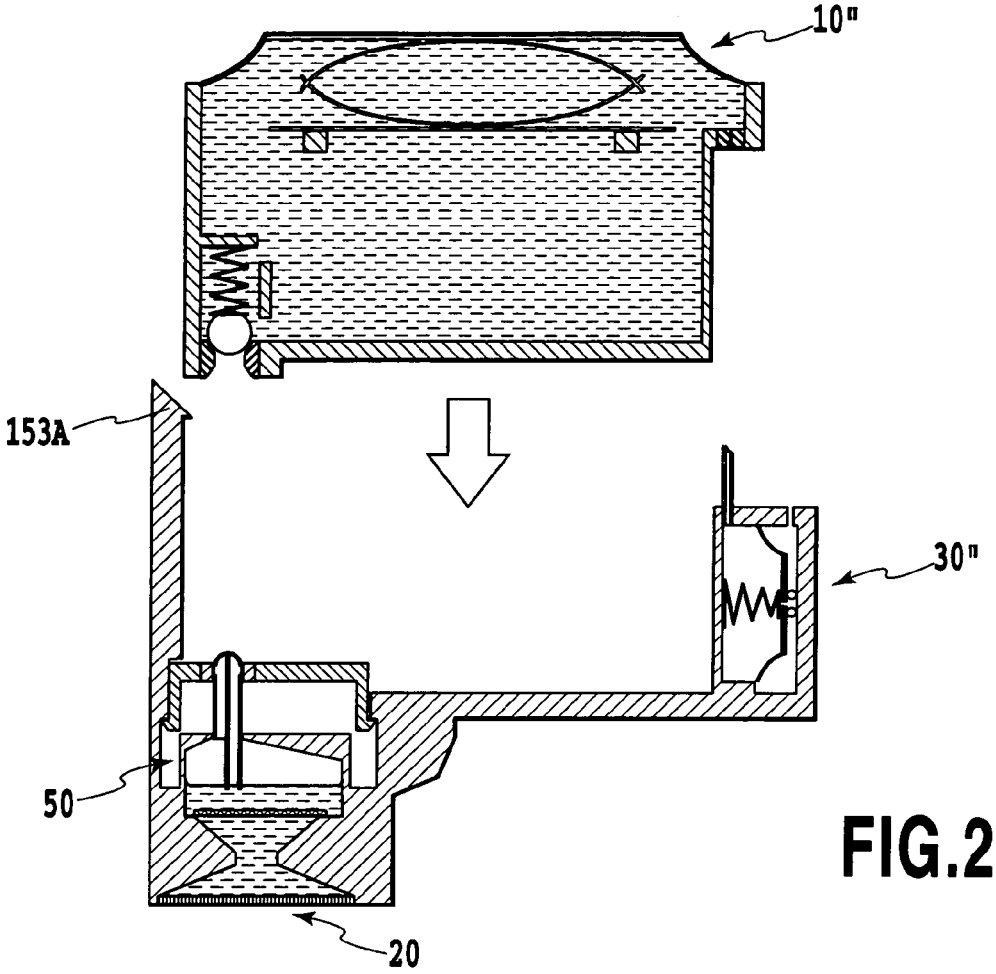
FIGS. 20A and 20B are sectional views showing a modified example of the configuration of FIGS. 19A and 19B.
Figure 20B:
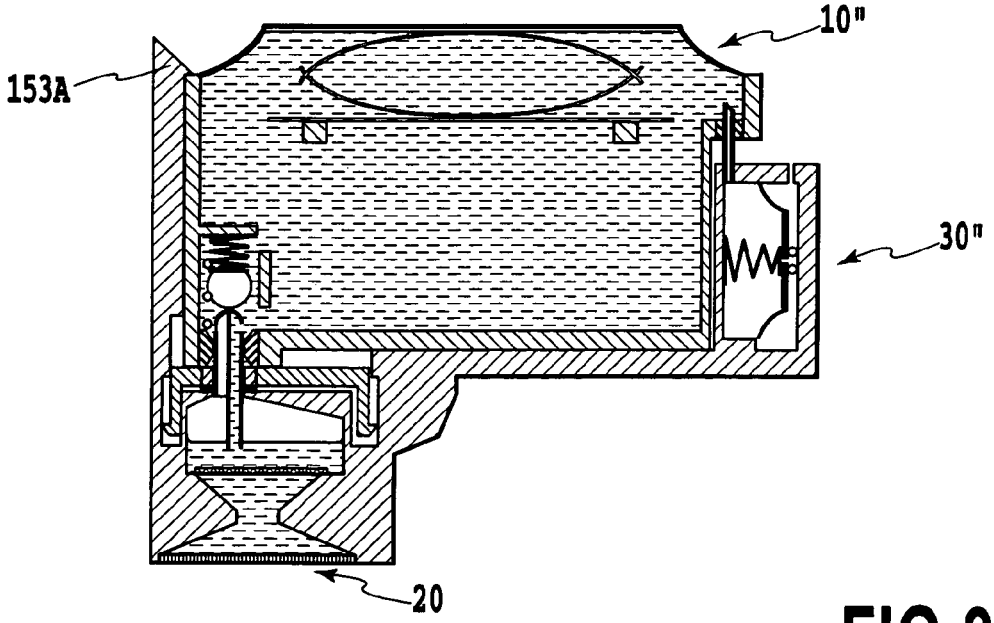

FIGS. 20A and 20B show a specific configuration example of such an ink supply system. This ink supply system has substantially the same configuration as in FIGS. 19A and 19B, except a valve chamber 30" is disposed on the carriage 153 side. The internal configuration of this valve chamber 30" is substantially the same as that of the aforesaid valve chamber 30, except a hollow needle 39 for introducing atmosphere projects upward from the valve chamber 30". Thus, the configuration is made such that as the attachment of an ink tank 10" is carried out, the hollow needle 39 sticks into the ink tank 10" via a sealing member 19, made of elastic member such as rubber, provided in the ink tank 10".

Even with such a configuration, the same operation as in the aforesaid first embodiment is performed and the same advantageous effect is obtained.

Example of Structure of Inkjet Printing Apparatus

Figure 21:
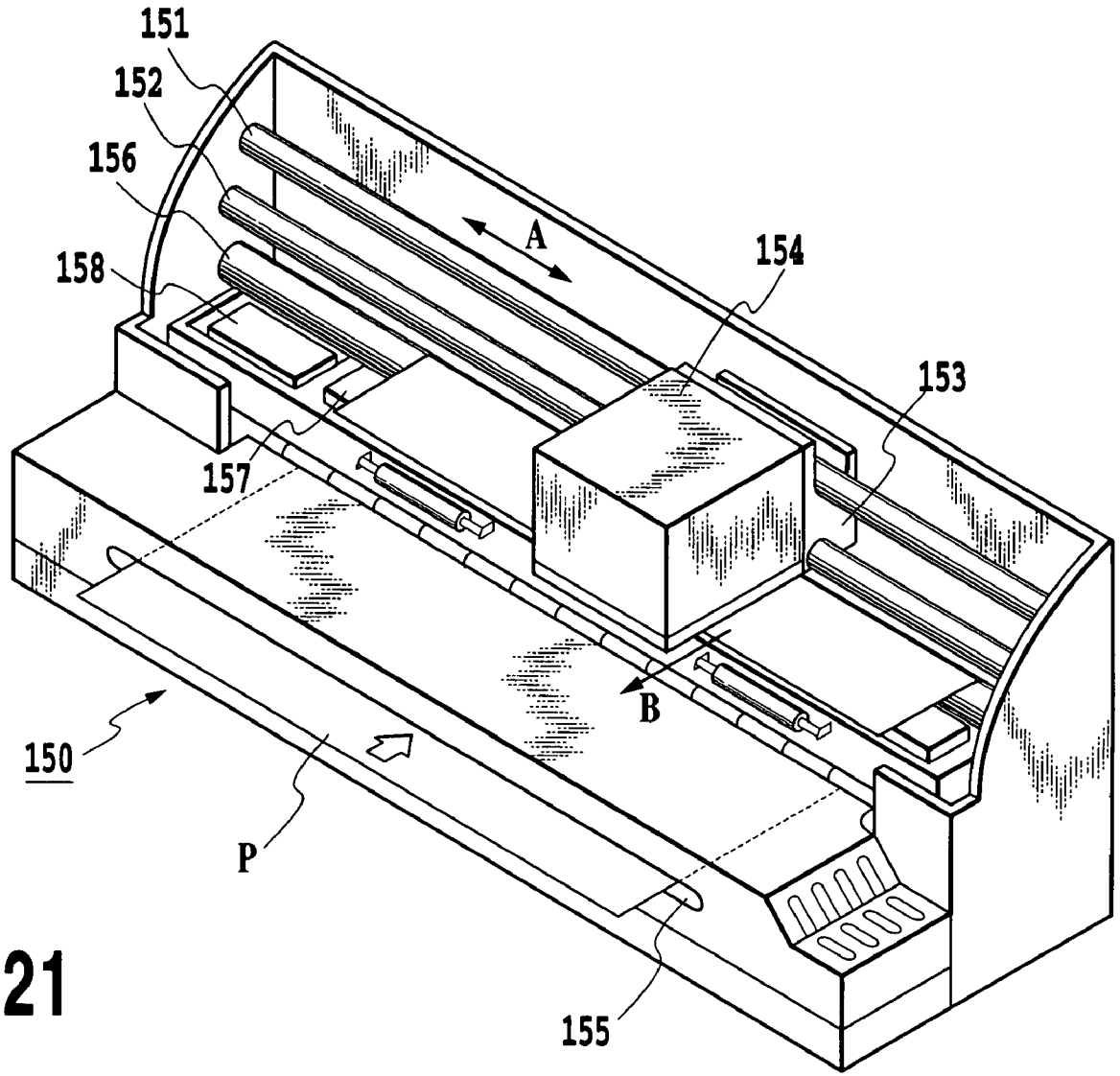
FIG. 21 is a perspective view showing a configuration example of an inkjet recording apparatus to which the invention is applicable.

FIG. 21 is a perspective view of an example of an inkjet recording apparatus to which the invention can be applied.

Such a recording apparatus is a serial type inkjet printing apparatus. In the recording apparatus 150 of the present embodiment, a carriage 153 is guided by guide shafts 151 and 152 such that it can be moved in main scanning directions indicated by the arrow A. The carriage 153 is moved back and forth in the main scanning direction by a carriage motor and a driving force transmission mechanism such as a belt for transmitting a driving force of the same motor. The carriage 153 carries an ink supply system 154 which may have any configuration of the above embodiments, for example as shown in FIGS. 19A and 19B, including an inkjet recording head, a liquid chamber (not shown in FIG. 17) and an ink tank for supplying ink to the inkjet recording head. Paper P as a recording medium is inserted into an insertion hole 155 provided at a forward end of the apparatus and is then transported in a sub-scanning direction indicated by the arrow B by a feed roller 156 after its transporting direction is inverted. The recording apparatus 150 sequentially forms images on the paper P by repeating a recording operation for ejecting ink toward a printing area on the paper P supported by a platen 157 while moving the recording head in the main scanning direction and a transporting operation for transporting the paper P in the sub-scanning direction a distance equivalent to a recording width.

The inkjet recording head may utilize thermal energy generated by an electrothermal transducer element as energy for ejecting ink. In this case, film boiling of ink is caused by the heat generated by the electrothermal transducer element, and ink is ejected from an ink ejection port by foaming energy generated at that time. The method of ejecting ink from the inkjet recording head is not limited to such a method utilizing an electrothermal transducer element and, for example, a method may be employed in which ink is ejected utilizing a piezoelectric element.

At the left end of the moving range of the carriage 153 in FIG. 21, there is provided a recovery system unit (recovery process unit) 158 that faces a surface of the inkjet printing head carried by the carriage 153 where an ink ejecting portion are formed. The recovery system unit 158 is equipped with a cap capable of capping the ink ejection portion of the recording head and a suction pump capable of introducing a negative pressure into the cap, and the unit can performs recovery process for maintaining a preferable ink ejecting condition of the inkjet recording head by introducing a negative pressure in the cap covering the ink ejection portion to suck and discharge ink through the ink ejection ports or orifices. Further, a recovery process for maintaining a preferable ink ejecting condition of the inkjet recording head by ejecting ink towards the cap (also referred to as "preliminary ejection process") may be performed other than the image forming. These processes may be performed to satisfy the condition expressed by Equation 4 or 11 when a new ink tank is installed.

Others

The aforesaid embodiments of the ink supply system basically all adopt the configuration made such that ink is stored or supplied directly without using an absorber or the like to hold ink therein. At the same time, negative pressure generating means is formed by a movable member (sheet member, pressure plate) and a spring member for urging this movable member. Besides, a sealing structure is formed inside the supply system. Thereby, the configuration is made such that a proper negative pressure is applied to the recording head.

In such configurations, volumetric efficiency is high and a degree of freedom in selecting ink can also be improved, as compared with the configuration in the conventional technique for generating a negative pressure through the absorber. In addition thereto, such configurations can also desirably meet a demand for the increase in flow rate or volume and stabilization of ink supply required as recording has been speeded up in recent years.

With the object of eliminating a gas stagnating in a supply channel on which object the invention particularly focuses, such a stagnant gas is transferred or discharged to the ink tank at the most upstream position farthest from the recording head. For this purpose, the configuration is made as follows. The ink tank and the ink supply channel are connected to each other via a plurality of flow channels. Besides, ink introduction out of the ink tank and gas introduction into the ink tank are performed in parallel by utilizing the balance in pressure between the ink tank and the ink supply channel.

According to such a configuration, the stagnant gas in the supply channel can be smoothly and rapidly eliminated and transferred to the ink tank side without the need for a complex apparatus and with a small increase in the number of components and a simple structure. Besides, the elimination is automatically timed in accordance with the balance in pressure when the gas has accumulated to some extent, so that the reliability of the gas elimination is high.

Besides, the negative pressure in the ink tank is always maintained in the process of the gas elimination. Therefore, liquid leakage from the ink ejection openings or the like of the inkjet recording head can be reliably prevented. Furthermore, the gas is eliminated and transferred to the ink tank side, whereby the amount of consumption of ink can be strikingly reduced, as compared with the method in which ink is sucked from the ejection openings of the recording head to thereby eliminate the gas. Thus, ink is kept from wasting away to contribute even to a reduction in running costs.

In addition, when using an ink tank configured to be attachable to and detachable from the supply channel, conventionally, to prevent a gas from entering the supply channel side during the ink tank replacing operation, the ink tank has been replaced in many cases, in the state where the supply channel is filled with ink, i.e., before ink is completely consumed. However, according to the aforesaid configuration, even if a gas enters the inside of the supply channel during the replacing operation, when a new ink tank is attached, the gas can be easily and rapidly eliminated from the ink tank. Therefore, the ink tank can be replaced after ink is completely consumed, thereby not only enabling a further reduction in running costs but also greatly contributing to environmental quality improvement. Furthermore, in any of the aforesaid embodiments, the ink tank is arranged at the highest elevation and the supply section or the recording head is arranged at the low elevation in terms of their positions during the normal use. This is a very desirable arrangement in performing the gas-liquid exchange rapidly and smoothly and with a simple configuration.

Additionally, although depending upon the configuration of the ink tank, a gas introduced into the ink tank may be stored anywhere inside the ink tank if stored at a position such that the gas will not return to the ink supply channel and the ink supply will not be hindered. However, the configuration of the aforesaid embodiment such that ink is stored directly without being impregnated into the absorber or the like is preferable because the gas introduced will be positioned directly in the uppermost portion inside the ink tank.

Thus, when the absorber is not in the ink tank, the volume of the tank itself can become the volume of ink. Therefore, the ink tank need not be more increased in volume than necessary, and the shape of the tank can also be comparatively freely designed.

Basic conditions for constituting the invention lie in the following configurations. The liquid chamber has a closed structure for storing ink directly except a portion connected to the ink tank and a portion connected to the recording head. Moreover, atmosphere introduction for maintaining a desirable negative pressure is performed directly with respect to the ink tank, so that a gas will not enter the liquid chamber communicating directly with the recording head. These conditions are significantly desirable in realizing the increase in flow rate or volume and stabilization of ink supply and always satisfactorily maintaining ejection characteristics even when high-speed recording (ejection) is performed. Besides, these conditions are not disclosed or suggested in any of the above documents.

As long as the negative pressure generating means has any configuration that fulfills these basic conditions, it can adopt any other configuration in addition to the configuration made by the combination of a spring and a flexible member as in the aforesaid each embodiment. That is, the basic conditions of the invention will not exclude the adoption of an absorber acting as the negative pressure generating means.

Figure 22:
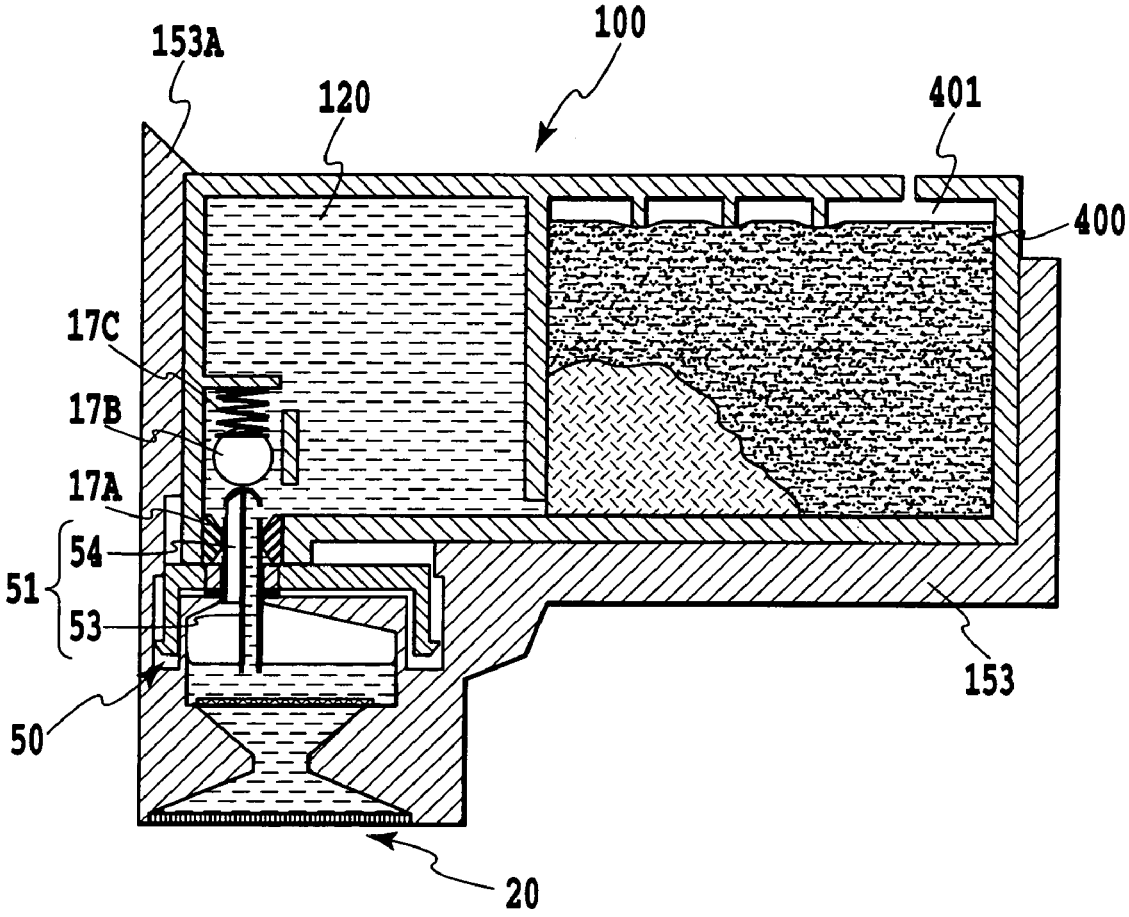
FIG. 22 is a sectional view for explaining an ink supply system according to still another embodiment of the invention.
Figure 23:
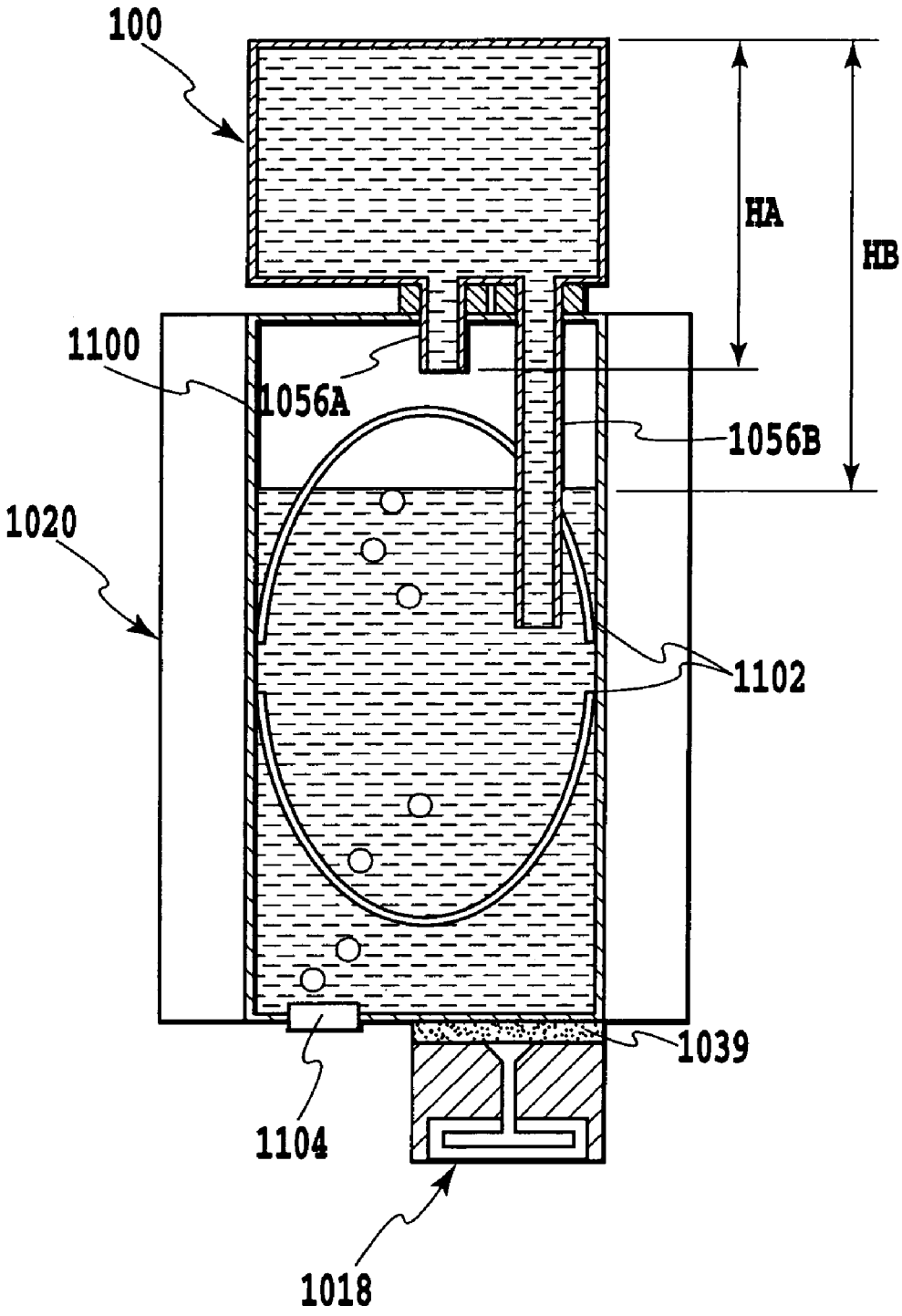
FIG. 23 is a sectional view for explaining a conventional example of an ink supply system.

FIG. 22 is a configuration example of the ink supply system configured such as to fulfill the aforesaid basic conditions even while using the absorber. Here, like reference numerals are given to corresponding portions out of the individual portions that can be configured similarly to those of FIGS. 19A and 19B.

In the configuration of this example, an ink tank 100 contains includes a liquid containing chamber 120 for directly containing ink and directly supplying ink to the liquid chamber and for receiving a gas discharge, and a negative pressure generating member housing chamber 401 that communicates with this liquid containing chamber 120, houses an absorber 400 acting as a member for sucking a liquid to thereby generate a negative pressure, and has the inside opened to atmosphere. The basic conditions of the invention can be fulfilled even by such a configuration and the number of components can be reduced to simplify the manufacturing process. Besides, needless to say, a gas existing on the side of the liquid chamber formed to have the closed structure can be rapidly and reliably transferred to and retained in the ink tank spaced away from the recording head, in accordance with the conditions of the pressure inside the ink tank, the pressure originating from a water head difference in each flow channel, and the pressure originating from a meniscus formed in each flow channel.

Besides, in the aforesaid description, the inkjet recording apparatus of serial type has been applied as the recording method of this embodiment. However, the invention and this embodiment are not limited thereto. Besides, the invention and this embodiment can be applied even to a recording apparatus of line scan type instead of serial type. Furthermore, needless to say, a plurality of liquid supply systems can be provided in correspondence to the color tones of ink (color, density and the like).

While the above description has referred to the application of the invention to an ink tank for supplying ink to a recording head, the invention may be applied to a supply section for supplying ink to a pen as a recording section.

In addition to various recording apparatus as thus described, the invention maybe used in a wide range including apparatus for supplying various liquids such as drinking water and liquid flavoring materials and apparatus for supplying pharmaceuticals in the medical field.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

The invention claimed is:

1. A fluid communication structure for providing fluid communication between a liquid containing section for containing a liquid and a liquid consuming section for consuming the liquid, said fluid communication structure comprising:

a liquid chamber communicating with said liquid consuming section; and plural communication channels for providing communication between said liquid chamber and said liquid containing section, wherein said plural communication channels have different heights of their opening positions in said liquid chamber side with reference to a vertical direction, and wherein said liquid chamber forms a substantial closed space except said plural communication channels and said liquid consuming section, and in a state where a gas exists inside the closed space, the gas can be transferred to said liquid containing section via a part of said plural communication channels.

2. A fluid communication structure as claimed in claim 1, wherein said fluid communication structure, in terms of its position during liquid consumption, is positioned substantially below said liquid containing section and positioned substantially above said liquid consuming section with reference to a vertical direction.

3. A fluid communication structure as claimed in claim 1, wherein in accordance with a relationship between a pressure difference originating from a water head of the liquid corresponding to a difference among the vertical heights of openings of said plural communication channels, inside said liquid consuming section and a difference among pressures originating from meniscuses formed by the liquid in the individual communication channels, an operation is performed such that, the gas in said closed space is transferred to said liquid containing section via the part of said plural communication channel, while the liquid is moved from said liquid containing section to said liquid consuming section via another part of said plural communication channels.

4. A fluid communication structure as claimed in claim 1, wherein only the part of said plural communication channels is formed such that a par of the openings inside said liquid consuming section comes into contact with an inner wall of said liquid consuming section.

5. A fluid communication structure as claimed in claim 1, wherein only the part of said plural communication channels has a portion forming a groove extending along the communication channel and projecting from the opening of the communication channel inside said liquid chamber.

6. A fluid communication structure as claimed in claim 1, wherein only the part of said plural communication channels is configured such that its opening inside the liquid chamber is always in contact with a liquid present in said liquid chamber.

7. A fluid communication structure as claimed in claim 1, wherein inner walls of said plural communication channels have different contact angles with the liquid.

8. A fluid communication structure as claimed in claim 1, wherein said plural communication channels have different inside diameters.

9. An inkjet recording head for ejecting an ink to thereby perform recording, the inkjet recording head having the fluid communication structure as claimed in claim 1 integral therewith.

10. An ink supply system, comprising:

a recording head for ejecting an ink;

a liquid chamber communicating with said recording head;

an ink tank for containing the ink and which includes pressure adjusting means for adjusting a pressure inside the system; and plural communication channels for providing communication between said liquid chamber and said ink tank, wherein said liquid chamber forms a substantial closed space except said plural communication channels and said recording head, wherein said pressure adjusting means performs the pressure adjustment so that a pressure that prevents leakage of the ink from said recording head and that permits an ink ejecting state of said recording head section acts inside the system; and wherein said pressure adjusting means has means for placing said recording head into a negative pressure state relative to an atmosphere pressure and means for introducing atmosphere directly into said ink tank without via said liquid chamber in order to adjust the negative pressure state.

11. An inkjet recording apparatus, wherein an ink supply system as claimed in claim 10 is used to perform recording as holding said ink supply system such that said liquid chamber is positioned substantially above said recording head and said ink tank is positioned substantially above said liquid chamber, in terms of their positions in use, with reference to a vertical direction.

* * * * *